US011051551B2

(12) United States Patent
Abramov et al.

(10) Patent No.: US 11,051,551 B2
(45) **Date of Patent: *Jul. 6, 2021**

(54) HEATING SMOKABLE MATERIAL

(71) Applicant: British American Tobacco (Investments) Limited, London (GB)

(72) Inventors: Oleg J. Abramov, St. Petersburg (RU); Petr Alexandrovich Egoyants, St. Petersburg (RU); Dmitry Mikhailovich Volobuev, St. Petersburg (RU); Pavel Nikolaevich Fimin, St. Petersburg (RU)

(73) Assignee: Nicoventures Trading Limited, London (GB)

( * ) Notice: Subject to any disclaimer, the term of this patent is extended or adjusted under 35 U.S.C. 154(b) by 151 days.

This patent is subject to a terminal disclaimer.

(21) Appl. No.: 15/991,512

(22) Filed: May 29, 2018

(65) Prior Publication Data

US 2018/0271171 A1 Sep. 27, 2018

Related U.S. Application Data

(63) Continuation of application No. 15/437,517, filed on Feb. 21, 2017, now Pat. No. 9,999,256, which is a (Continued)

(30) Foreign Application Priority Data

| | | |
|---|---|---|
| Sep. 6, 2011 | (RU) | RU2011136869 |
| Apr. 23, 2012 | (GB) | 1207054 |
| Jun. 15, 2012 | (RU) | RU2012124800 |

(51) Int. Cl.

| | |
|---|---|
| ***A24F 40/46*** | (2020.01) |
| ***A24F 40/20*** | (2020.01) |

(Continued)

(52) U.S. Cl.

CPC ..... *A24F 40/46* (2020.01); *A24F 40/20* (2020.01); *A24F 40/57* (2020.01); *A24D 1/20* (2020.01)

(58) Field of Classification Search

CPC ..... A24F 40/20; A24F 40/46

See application file for complete search history.

(56) References Cited

U.S. PATENT DOCUMENTS

| | | | |
|---|---|---|---|
| 844,272 | A | 2/1907 | Fate |
| 912,986 | A | 2/1909 | Aschenbrenner |

(Continued)

FOREIGN PATENT DOCUMENTS

| | | |
|---|---|---|
| AT | 508244 | 12/2010 |
| AT | 510405 | 4/2012 |

(Continued)

OTHER PUBLICATIONS

Collier J.G. et al., "10.3 Mechanism of Evaporation and Condensation," Convective Boiling and Condensation, Third Edition, Clarendon Press, 1994, 6 pages.

(Continued)

*Primary Examiner* — Anthony Calandra

(74) *Attorney, Agent, or Firm* — Patterson Thuente Pedersen, P.A.

(57) ABSTRACT

An apparatus comprising a smokable material heater, configured to heat a first region of smokable material to a volatizing temperature sufficient to volatize a component of smokable material and to concurrently heat a second region of smokable material to a temperature lower than said volatizing temperature but which is sufficient to prevent condensation of volatized components of the smokable material. A method of heating smokable material is also described.

13 Claims, 10 Drawing Sheets

Related U.S. Application Data continuation of application No. 14/343,368, filed as application No. PCT/EP2012/066525 on Aug. 24, 2012, now Pat. No. 9,609,894.

(51) Int. Cl.
*A24F 40/57* (2020.01)
*A24D 1/20* (2020.01)

(56) References Cited

U.S. PATENT DOCUMENTS 1,071,817 A 9/1913 Stanley
1,771,366 A 7/1930 Wyss et al.
1,886,391 A 11/1932 Henri et al.
2,057,353 A 10/1936 Whittemore
2,104,266 A 1/1938 McCormick
2,473,325 A 6/1949 Aufiero
2,809,634 A 10/1957 Murai
3,111,396 A 11/1963 Ball
3,225,954 A 12/1965 Herrick et al.
3,265,236 A 8/1966 Norman et al.
3,402,724 A 6/1968 Blount
3,431,393 A 3/1969 Katsuda
3,433,632 A 3/1969 Elbert
3,521,643 A 7/1970 Toth
3,604,428 A 9/1971 Moukaddem
3,804,100 A 4/1974 Fariello
3,805,806 A 4/1974 Grihalva
3,889,690 A 6/1975 Guarnieri
3,964,902 A 6/1976 Fletcher
4,009,713 A 3/1977 Simmons
4,031,906 A 6/1977 Knapp
4,094,119 A 6/1978 Sullivan
4,145,001 A 3/1979 Weyenberg
4,161,283 A 7/1979 Hyman
4,171,000 A 10/1979 Uhle
4,193,513 A 3/1980 Bull
4,303,083 A 12/1981 Burruss et al.
4,412,930 A 11/1983 Koike et al.
4,427,123 A 1/1984 Komeda et al.
4,474,191 A 10/1984 Steiner
4,503,851 A 3/1985 Brauroth
4,588,976 A 5/1986 Jaselli
4,628,187 A 12/1986 Sekiguchi et al.
4,638,820 A 1/1987 Roberts et al.
4,675,508 A 6/1987 Miyaji et al.
4,676,237 A 6/1987 Wood
4,677,992 A 7/1987 Bliznak
4,694,841 A 9/1987 Esparza
4,734,097 A 3/1988 Tanabe
4,735,217 A 4/1988 Gerth et al.
4,756,318 A 7/1988 Clearman et al.
4,765,347 A 8/1988 Sensabaugh et al.
4,830,028 A 5/1989 Lawson
4,848,374 A 7/1989 Chard
4,885,129 A 12/1989 Leonard
4,892,109 A 1/1990 Strubel
4,907,606 A 3/1990 Lilja et al.
4,917,301 A 4/1990 Munteanu
4,922,901 A 5/1990 Brooks et al.
4,945,929 A 8/1990 Egilmex
4,945,931 A 8/1990 Gori
4,947,874 A 8/1990 Brooks et al.
4,947,875 A 8/1990 Brooks et al.
4,978,814 A 12/1990 Honour
5,027,837 A 7/1991 Clearman
5,040,551 A 8/1991 Schlatter et al.
5,046,514 A 9/1991 Bolt
5,060,671 A 10/1991 Counts et al.
5,093,894 A 3/1992 Deevi et al.
5,095,647 A 3/1992 Zobele
5,095,921 A 3/1992 Losee et al.
5,096,921 A 3/1992 Bollinger
5,099,861 A 3/1992 Clearman et al.
5,121,881 A 6/1992 Lembeck
5,143,048 A 9/1992 Cheney, III
5,144,962 A 9/1992 Counts et al.
5,167,242 A 12/1992 Turner
5,179,966 A 1/1993 Losee et al.
5,190,060 A 3/1993 Gerding et al.
5,203,355 A 4/1993 Clearman et al.
5,224,498 A 7/1993 Deevi et al.
5,247,947 A 9/1993 Clearman et al.
5,249,586 A 10/1993 Morgan et al.
5,251,688 A 10/1993 Schatz
5,261,424 A 11/1993 Sprinkel et al.
5,269,327 A 12/1993 Counts et al.
5,271,980 A 12/1993 Bell
5,285,798 A 2/1994 Banerjee et al.
5,303,720 A 4/1994 Banerjee et al.
5,305,733 A 4/1994 Walters
5,322,075 A 6/1994 Deevi et al.
5,327,915 A 7/1994 Porenski et al.
5,331,979 A 7/1994 Henley
5,345,951 A 9/1994 Serrano et al.
5,353,813 A 10/1994 Deevi et al.
5,369,723 A 11/1994 Counts et al.
5,372,148 A 12/1994 McCafferty
5,388,574 A 2/1995 Ingebrethsen
5,388,594 A 2/1995 Counts et al.
5,390,864 A 2/1995 Alexander
5,402,803 A 4/1995 Takagi
5,408,574 A 4/1995 Deevi et al.
5,434,388 A 7/1995 Kralik et al.
5,468,936 A 11/1995 Deevi et al.
5,479,948 A 1/1996 Counts
5,497,792 A 3/1996 Prasad
5,501,236 A 3/1996 Hill
5,505,214 A 4/1996 Collins et al.
5,530,225 A 6/1996 Hajaligol
5,534,020 A 7/1996 Cheney
5,540,241 A 7/1996 Kim
5,553,791 A 9/1996 Alexander
5,573,140 A 11/1996 Satomi et al.
5,573,692 A 11/1996 Das et al.
5,613,504 A 3/1997 Collins et al.
5,613,505 A 3/1997 Campbell et al.
5,636,787 A 6/1997 Gowhari
5,649,554 A 7/1997 Murphy
5,665,262 A 9/1997 Hajaligol et al.
5,666,977 A 9/1997 Higgins
5,692,291 A 12/1997 Seetharama
5,742,251 A 4/1998 Gerber
5,743,251 A 4/1998 Howell et al.
5,771,845 A 6/1998 Pistien et al.
5,798,154 A 8/1998 Bryan
5,865,185 A 2/1999 Collins
5,865,186 A 2/1999 Volsey et al.
5,984,953 A 11/1999 Sabin
6,026,820 A 2/2000 Baggett et al.
6,037,568 A 3/2000 Hatanaka et al.
6,040,560 A 3/2000 Fleischhauer et al.
6,058,711 A 5/2000 Maciaszek
6,089,857 A 7/2000 Matsuura et al.
6,095,505 A 8/2000 Miller
6,116,231 A 9/2000 Sabin
6,125,853 A 10/2000 Susa et al.
6,155,268 A 12/2000 Takeuchi
6,224,179 B1 5/2001 Wenning
6,275,650 B1 8/2001 Lambert
6,289,889 B1 9/2001 Bell
6,315,366 B1 11/2001 Post et al.
6,376,816 B2 4/2002 Cooper et al.
6,644,383 B2 11/2003 Joseph
6,652,804 B1 11/2003 Neuann
6,681,998 B2 1/2004 Sharpe
6,701,921 B2 3/2004 Sprinkel
6,723,115 B1 4/2004 Daly
6,790,496 B1 9/2004 Levander et al.
6,827,080 B2 12/2004 Fish
6,868,230 B2 3/2005 Gerhardinger
6,953,474 B2 10/2005 Lu
6,994,096 B2 2/2006 Rostami et al.
7,100,618 B2 9/2006 Dominquez

(56) References Cited

U.S. PATENT DOCUMENTS 7,112,712 B1 9/2006 Ancell
7,263,282 B2 8/2007 Meyer
7,374,063 B2 5/2008 Reid
7,400,940 B2 7/2008 McRae
7,540,286 B2 6/2009 Cross
7,624,739 B2 12/2009 Snaidr et al.
7,726,320 B2 6/2010 Robinson et al.
7,767,698 B2 8/2010 Warchol
7,832,410 B2 11/2010 Hon
7,913,688 B2 3/2011 Cross et al.
7,992,554 B2 8/2011 Radomski
8,061,361 B2 11/2011 Maeder et al.
8,079,371 B2 12/2011 Robinson et al.
8,081,474 B1 12/2011 Zohni et al.
8,118,021 B2 2/2012 Cho
8,156,944 B2 4/2012 Hon
8,365,742 B2 2/2013 Hon
8,375,957 B2 2/2013 Hon
8,393,331 B2 3/2013 Hon
8,430,106 B2 4/2013 Potter et al.
8,490,628 B2 7/2013 Hon
8,511,318 B2 8/2013 Hon
8,678,013 B2 3/2014 Crooks et al.
8,752,545 B2 6/2014 Buchberger
8,757,404 B1 6/2014 Fleckenstein
8,689,805 B2 8/2014 Hon
8,807,140 B1 8/2014 Scatterday
8,833,364 B2 9/2014 Buchberger
8,899,238 B2 12/2014 Robinson
8,948,578 B2 2/2015 Buchberger
9,357,803 B2 6/2016 Egoyants et al.
9,414,619 B2 8/2016 Sizer et al.
9,414,629 B2 8/2016 Egoyants et al.
9,554,598 B2 1/2017 Egoyants et al.
9,609,894 B2 4/2017 Abramov et al.
9,623,205 B2 4/2017 Buchberger
9,693,587 B2 7/2017 Plojoux
9,980,523 B2 5/2018 Abramov et al.
9,999,256 B2 6/2018 Abramov et al.
10,010,695 B2 7/2018 Buchberger
10,045,562 B2 8/2018 Buchberger
10,524,516 B2 * 1/2020 Alelov ..... A24F 40/50
2001/0042546 A1 11/2001 Umeda et al.
2002/0005207 A1 1/2002 Wrenn et al.
2002/0016370 A1 2/2002 Shytle
2002/0079309 A1 6/2002 Cox et al.
2002/0079377 A1 6/2002 Nichols
2003/0005620 A1 1/2003 Shytle
2003/0049025 A1 3/2003 Neumann et al.
2003/0079309 A1 6/2003 Cox
2003/0106552 A1 6/2003 Sprinkel
2003/0108342 A1 6/2003 Sherwood
2003/0146224 A1 8/2003 Fujii et al.
2003/0200964 A1 10/2003 Blakley
2003/0202169 A1 10/2003 Liu
2004/0003820 A1 1/2004 Iannuzzi
2004/0031485 A1 2/2004 Rustad
2004/0096204 A1 5/2004 Gerhardinger
2004/0129793 A1 7/2004 Nguyen et al.
2004/0149296 A1 8/2004 Rostami et al.
2004/0149297 A1 8/2004 Sharpe
2004/0149737 A1 8/2004 Sharpe et al.
2004/0210151 A1 10/2004 Tsukashima
2004/0226568 A1 11/2004 Takeuchi
2005/0063686 A1 3/2005 Whittle et al.
2005/0145260 A1 7/2005 Inagaki
2005/0194013 A1 9/2005 Wright
2005/0204799 A1 9/2005 Koch
2005/0211711 A1 9/2005 Reid
2005/0268911 A1 12/2005 Cross et al.
2006/0078477 A1 4/2006 Althouse
2006/0137681 A1 6/2006 Von Hollen
2007/0014549 A1 1/2007 Demarest et al.
2007/0045288 A1 3/2007 Nelson
2007/0062548 A1 3/2007 Horstmann
2007/0074734 A1 4/2007 Braunshteyn et al.
2007/0102013 A1 5/2007 Adams et al.
2007/0107879 A1 5/2007 Radomsnki
2007/0155255 A1 7/2007 Galauner et al.
2007/0204858 A1 9/2007 Abelbeck
2007/0204868 A1 9/2007 Bollinger et al.
2007/0283972 A1 12/2007 Monsees et al.
2008/0085139 A1 4/2008 Roof
2008/0092912 A1 4/2008 Robinson et al.
2008/0156326 A1 7/2008 Belcastro
2008/0216828 A1 9/2008 Wensley et al.
2008/0233318 A1 9/2008 Coyle
2008/0241255 A1 10/2008 Rose
2008/0302374 A1 12/2008 Wengert et al.
2009/0032034 A1 2/2009 Steinberg
2009/0056728 A1 3/2009 Baker
2009/0065011 A1 3/2009 Maeder
2009/0090472 A1 4/2009 Radomski
2009/0095311 A1 4/2009 Han
2009/0126745 A1 5/2009 Hon
2009/0151717 A1 6/2009 Bowen et al.
2009/0188490 A1 7/2009 Han
2009/0241947 A1 10/2009 Bedini
2009/0260641 A1 10/2009 Monsees et al.
2009/0272379 A1 11/2009 Thorens et al.
2009/0293892 A1 12/2009 Williams
2009/0304372 A1 12/2009 Gubler et al.
2010/0059070 A1 3/2010 Potter
2010/0065653 A1 3/2010 Potter
2010/0083959 A1 4/2010 Siller
2010/0108059 A1 5/2010 Axelsson et al.
2010/0126516 A1 5/2010 Yomtov et al.
2010/0147299 A1 6/2010 Row et al.
2010/0200006 A1 8/2010 Robinson et al.
2010/0236546 A1 9/2010 Yamada
2010/0242974 A1 9/2010 Pan
2010/0242975 A1 9/2010 Hearn
2010/0300467 A1 12/2010 Kuistila et al.
2010/0307518 A1 12/2010 Wang
2011/0011396 A1 1/2011 Fang
2011/0094523 A1 4/2011 Thorens et al.
2011/0126848 A1 6/2011 Zuber et al.
2011/0155153 A1 6/2011 Thorens et al.
2011/0155718 A1 6/2011 Greim et al.
2011/0192914 A1 8/2011 Ishigami
2011/0226236 A1 9/2011 Buchberger
2011/0264084 A1 10/2011 Reid
2011/0277757 A1 11/2011 Terry
2011/0036363 A1 12/2011 Urtsev
2011/0090266 A1 12/2011 Koeller
2011/0290266 A1 12/2011 Koeller
2011/0290267 A1 12/2011 Yamada
2011/0297166 A1 12/2011 Takeuchi
2011/0303231 A1 12/2011 Li
2012/0006342 A1 1/2012 Rose et al.
2012/0132196 A1 5/2012 Vladyslavovych
2012/0145169 A1 6/2012 Wu
2012/0234821 A1 9/2012 Shimizu
2012/0255546 A1 10/2012 Goetz et al.
2012/0260927 A1 10/2012 Liu
2012/0285476 A1 11/2012 Hon
2013/0042865 A1 2/2013 Monsees et al.
2013/0074857 A1 3/2013 Buchberger
2013/0081623 A1 4/2013 Buchberger
2013/0087160 A1 4/2013 Gherge
2013/0133675 A1 5/2013 Shinozaki
2013/0142782 A1 6/2013 Rahmel
2013/0192615 A1 8/2013 Tucker
2013/0213419 A1 8/2013 Tucker
2013/0284192 A1 10/2013 Peleg
2013/0306084 A1 11/2013 Flick
2013/0333700 A1 12/2013 Buchberger
2013/0340779 A1 12/2013 Liu
2014/0000638 A1 1/2014 Sebastian
2014/0060528 A1 3/2014 Liu
2014/0060554 A1 3/2014 Collett
2014/0060555 A1 3/2014 Chang
2014/0182608 A1 7/2014 Egoyants et al.
2014/0182843 A1 7/2014 Vinegar

(56) References Cited

U.S. PATENT DOCUMENTS

| | | | |
|---|---|---|---|
| 2014/0202454 | A1 | 7/2014 | Buchberger |
| 2014/0202476 | A1 | 7/2014 | Egoyants et al. |
| 2014/0209105 | A1 | 7/2014 | Sears |
| 2014/0216485 | A1 | 8/2014 | Egoyants et al. |
| 2014/0238396 | A1 | 8/2014 | Buchberger |
| 2014/0238423 | A1 | 8/2014 | Tucker |
| 2014/0238424 | A1 | 8/2014 | Tucker |
| 2014/0261490 | A1 | 9/2014 | Kane |
| 2014/0270726 | A1 | 9/2014 | Egoyants et al. |
| 2014/0270730 | A1 | 9/2014 | DePiano |
| 2014/0283825 | A1 | 9/2014 | Buchberger |
| 2014/0286630 | A1 | 9/2014 | Buchberger |
| 2014/0299125 | A1 | 10/2014 | Buchberger |
| 2014/0305449 | A1 | 10/2014 | Plojoux et al. |
| 2014/0326257 | A1 | 11/2014 | Jalloul et al. |
| 2014/0334802 | A1 | 11/2014 | Dubief |
| 2014/0338680 | A1 | 11/2014 | Abramov et al. |
| 2014/0360515 | A1 | 12/2014 | Vasiliev et al. |
| 2015/0040925 | A1 | 2/2015 | Saleem et al. |
| 2015/0114411 | A1 | 4/2015 | Buchberger |
| 2015/0142088 | A1 | 5/2015 | Riva |
| 2015/0157055 | A1 | 6/2015 | Lord |
| 2015/0196058 | A1 | 7/2015 | Lord |
| 2015/0208728 | A1 | 7/2015 | Lord |
| 2015/0223520 | A1 | 8/2015 | Phillips et al. |
| 2016/0003403 | A1 | 1/2016 | Smith |
| 2016/0073693 | A1 | 3/2016 | Reevell |
| 2016/0106154 | A1 | 4/2016 | Lord |
| 2016/0106155 | A1 | 4/2016 | Reevell |
| 2016/0146506 | A1 | 5/2016 | Brereton et al. |
| 2016/0168438 | A1 | 6/2016 | Harding et al. |
| 2016/0255879 | A1 | 9/2016 | Paprocki et al. |
| 2017/0006916 | A1 | 1/2017 | Qiuming |
| 2017/0042245 | A1 | 2/2017 | Buchberger |
| 2017/0095006 | A1 | 4/2017 | Egoyants et al. |
| 2017/0119048 | A1 | 5/2017 | Kaufman et al. |
| 2017/0119049 | A1 | 5/2017 | Blandino et al. |
| 2017/0119050 | A1 | 5/2017 | Blandino et al. |
| 2017/0156406 | A1 | 6/2017 | Abramov et al. |
| 2017/0156407 | A1 | 6/2017 | Abramov et al. |
| 2017/0197043 | A1 | 7/2017 | Buchberger |
| 2017/0197044 | A1 | 7/2017 | Buchberger |
| 2017/0197046 | A1 | 7/2017 | Buchberger |
| 2017/0197048 | A1 | 7/2017 | Khosrowshahi et al. |
| 2017/0197049 | A1 | 7/2017 | Doll |
| 2017/0197050 | A1 | 7/2017 | Reinburg et al. |
| 2017/0231281 | A1 | 8/2017 | Hatton |
| 2017/0303585 | A1 | 10/2017 | Florack |
| 2017/0332700 | A1 | 11/2017 | Plews |
| 2017/0340008 | A1 | 11/2017 | Sebastian |
| 2019/0000142 | A1 | 1/2019 | Lavanchy |
| 2019/0014820 | A1 | 1/2019 | Malgat |

FOREIGN PATENT DOCUMENTS

| | | | |
|---|---|---|---|
| AT | 510504 | | 4/2012 |
| AU | 63931/73 | | 6/1975 |
| CA | 2309376 | | 11/2000 |
| CA | 2712412 | | 12/2009 |
| CH | 698603 | B1 | 9/2009 |
| CL | 199400288 | A1 | 8/1995 |
| CL | 2007002226 | A1 | 2/2008 |
| CL | 2013003637 | A1 | 7/2014 |
| CL | 2014002840 | A1 | 12/2014 |
| CN | 86102917 | A | 11/1987 |
| CN | 1040914 | A | 4/1990 |
| CN | 1045691 | A | 10/1990 |
| CN | 2092880 | | 1/1992 |
| CN | 1106812 | A | 8/1995 |
| CN | 2220168 | | 2/1996 |
| CN | 1122213 | A | 5/1996 |
| CN | 2246744 | Y | 2/1997 |
| CN | 1195270 | A | 10/1998 |
| CN | 1196660 | A | 10/1998 |
| CN | 1196661 | A | 10/1998 |
| CN | 1205849 | A | 1/1999 |
| CN | 1106812 | C | 4/2003 |
| CN | 2598364 | Y | 1/2004 |
| CN | 1578895 | A | 2/2005 |
| CN | 2719043 | | 8/2005 |
| CN | 1694765 | A | 11/2005 |
| CN | 101238047 | A | 8/2008 |
| CN | 101267749 | A | 9/2008 |
| CN | 101277622 | A | 10/2008 |
| CN | 101282660 | A | 10/2008 |
| CN | 201185656 | Y | 1/2009 |
| CN | 201238609 | | 5/2009 |
| CN | 101500443 | | 8/2009 |
| CN | 101516425 | | 8/2009 |
| CN | 101557728 | A | 10/2009 |
| CN | 201375023 | | 1/2010 |
| CN | 201375023 | Y | 1/2010 |
| CN | 101648041 | A | 2/2010 |
| CN | 101878958 | | 11/2010 |
| CN | 101925309 | A | 12/2010 |
| CN | 201869778 | U | 6/2011 |
| CN | 102131411 | A | 7/2011 |
| CN | 202172846 | | 3/2012 |
| CN | 102604599 | | 7/2012 |
| CN | 102655773 | A | 9/2012 |
| CN | 202722498 | | 2/2013 |
| CN | 202750708 | | 2/2013 |
| CN | 103054196 | A | 4/2013 |
| CN | 103359550 | A | 10/2013 |
| CN | 106102863 | A | 11/2016 |
| DE | 1950439 | | 4/1971 |
| DE | 3148335 | | 7/1983 |
| DE | 3218760 | | 12/1983 |
| DE | 3936687 | | 5/1992 |
| DE | 29713866 | U1 | 10/1997 |
| DE | 29719509 | U1 | 1/1998 |
| DE | 19630619 | | 2/1998 |
| DE | 19654945 | | 3/1998 |
| DE | 10330681 | | 6/2004 |
| DE | 202006013439 | | 10/2006 |
| DE | 102005023278 | A1 | 11/2006 |
| DE | 102010046482 | | 3/2012 |
| DE | 202013100606 | | 2/2013 |
| DE | 102013002555 | | 6/2014 |
| EP | 280262 | | 8/1988 |
| EP | 0309227 | A2 | 3/1989 |
| EP | 0358002 | A2 | 3/1990 |
| EP | 0358002 | A2 | 3/1990 |
| EP | 0358114 | A2 | 3/1990 |
| EP | 0371285 | A2 | 6/1990 |
| EP | 0418464 | | 3/1991 |
| EP | 0430559 | A2 | 6/1991 |
| EP | 0430566 | A2 | 6/1991 |
| EP | 0438862 | A2 | 7/1991 |
| EP | 0444553 | | 9/1991 |
| EP | 0488488 | A1 | 6/1992 |
| EP | 0491 952 | A1 | 7/1992 |
| EP | 0503767 | A1 | 9/1992 |
| EP | 0603613 | A1 | 6/1994 |
| EP | 0845220 | A1 | 6/1998 |
| EP | 0295122 | | 12/1998 |
| EP | 0893071 | | 1/1999 |
| EP | 1128743 | | 9/2001 |
| EP | 1166814 | | 1/2002 |
| EP | 1166847 | | 1/2002 |
| EP | 0845220 | B1 | 9/2003 |
| EP | 1609376 | A1 | 12/2005 |
| EP | 1618803 | A1 | 1/2006 |
| EP | 1736065 | | 12/2006 |
| EP | 1736065 | A1 | 12/2006 |
| EP | 1757921 | | 2/2007 |
| EP | 2011033 | A2 | 1/2009 |
| EP | 2018886 | | 1/2009 |
| EP | 2022349 | | 2/2009 |
| EP | 2022349 | A1 | 2/2009 |
| EP | 2110033 | A1 | 10/2009 |
| EP | 2113178 | | 11/2009 |
| EP | 1947965 | B1 | 2/2010 |
| EP | 2316286 | A1 | 5/2011 |

(56) References Cited

FOREIGN PATENT DOCUMENTS

| | | | |
|---|---|---|---|
| EP | 2327318 | A1 | 6/2011 |
| EP | 2340729 | A1 | 7/2011 |
| EP | 2340730 | A1 | 7/2011 |
| EP | 2394520 | A1 | 12/2011 |
| EP | 2520186 | A1 | 11/2012 |
| EP | 2698070 | | 2/2014 |
| EP | 2762019 | | 8/2014 |
| EP | 2835062 | | 2/2015 |
| ES | H05115272 | A | 5/1993 |
| FR | 960469 | | 4/1950 |
| GB | 25575 | | 3/1912 |
| GB | 191126138 | A | 3/1912 |
| GB | 426247 | A | 3/1935 |
| GB | 1313525 | | 4/1973 |
| HK | 1196511 | | 12/2014 |
| HK | 1226611 | | 10/2017 |
| JP | 53014173 | | 2/1978 |
| JP | S57-052456 | | 3/1982 |
| JP | S59-106340 | | 1/1986 |
| JP | S61-096763 | | 5/1986 |
| JP | S62501050 | A | 4/1987 |
| JP | 62205184 | | 9/1987 |
| JP | 61-096765 | | 1/1988 |
| JP | S 6360322 | | 3/1988 |
| JP | S63127399 | U | 8/1988 |
| JP | H01191674 | | 8/1989 |
| JP | 02092986 | | 4/1990 |
| JP | 2124081 | | 5/1990 |
| JP | 02127493 | | 5/1990 |
| JP | 02190171 | | 7/1990 |
| JP | 03041185 | | 2/1991 |
| JP | H03192677 | A | 8/1991 |
| JP | H03232481 | A | 10/1991 |
| JP | H5-103836 | | 4/1993 |
| JP | H05212100 | A | 8/1993 |
| JP | H05-309136 | | 11/1993 |
| JP | 6-2164 | | 1/1994 |
| JP | H06189861 | A | 7/1994 |
| JP | H6-315366 | A | 11/1994 |
| JP | H06315366 | A | 11/1994 |
| JP | H8-511176 | | 10/1995 |
| JP | H08942 | U | 6/1996 |
| JP | H08-299862 | | 11/1996 |
| JP | H08511176 | A | 11/1996 |
| JP | H09107943 | A | 4/1997 |
| JP | 3044574 | U | 12/1997 |
| JP | 11089551 | | 4/1999 |
| JP | H1189551 | A | 4/1999 |
| JP | H11125391 | A | 5/1999 |
| JP | H11169157 | A | 6/1999 |
| JP | 2000119643 | | 4/2000 |
| JP | 2001063776 | | 3/2001 |
| JP | 2011518567 | | 1/2002 |
| JP | 2002529111 | | 9/2002 |
| JP | 2004332069 | | 11/2004 |
| JP | 2005036897 | A | 2/2005 |
| JP | 2005106350 | A | 4/2005 |
| JP | 2005300005 | A | 10/2005 |
| JP | 2005-538159 | | 12/2005 |
| JP | 2005537918 | A | 12/2005 |
| JP | 2006501871 | A | 1/2006 |
| JP | 2006219557 | | 8/2006 |
| JP | 2008249003 | A | 10/2008 |
| JP | 2009-509523 | | 3/2009 |
| JP | 2009-537119 | | 10/2009 |
| JP | 2009537120 | A | 10/2009 |
| JP | 2010506594 | A | 3/2010 |
| JP | 2010178730 | A | 8/2010 |
| JP | 2010213579 | A | 9/2010 |
| JP | 2011058538 | A | 3/2011 |
| JP | 2011509667 | A | 3/2011 |
| JP | 2011515080 | A | 5/2011 |
| JP | 2011135901 | A | 7/2011 |
| JP | 2012-249854 | | 12/2012 |
| JP | 5193668 | B2 | 5/2013 |
| JP | 2014519586 | A | 8/2014 |
| JP | 2015513922 | A | 5/2015 |
| JP | 6217980 | B2 | 10/2017 |
| KR | 950700692 | A | 2/1995 |
| KR | 19990081973 | A | 11/1999 |
| KR | 100286488 | | 4/2001 |
| KR | 100286488 | B1 | 4/2001 |
| KR | 200350504 | Y1 | 5/2004 |
| KR | 200370872 | Y1 | 12/2004 |
| KR | 100636287 | B1 | 10/2006 |
| KR | 20070038350 | A | 4/2007 |
| KR | 100757450 | B1 | 9/2007 |
| KR | 20080060218 | A | 7/2008 |
| KR | 20100135865 | A | 12/2010 |
| KR | 20120003484 | U | 5/2012 |
| KR | 20120104533 | A | 9/2012 |
| KR | 20130006714 | | 11/2013 |
| MX | 2009001096 | A | 3/2009 |
| MX | 2014011283 | A | 10/2014 |
| RU | 2066337 | C1 | 9/1996 |
| RU | 2098446 | C1 | 12/1997 |
| RU | 2285028 | C1 | 10/2006 |
| RU | 2311859 | C2 | 12/2007 |
| RU | 2336001 | C2 | 10/2008 |
| RU | 89927 | U1 | 12/2009 |
| RU | 94815 | U1 | 6/2010 |
| RU | 103281 | U1 | 4/2011 |
| RU | 115629 | U1 | 5/2012 |
| RU | 122000 | U1 | 11/2012 |
| RU | 124120 | | 1/2013 |
| RU | 132318 | | 9/2013 |
| RU | 2509516 | | 3/2014 |
| WO | WO-8602528 | A1 | 5/1986 |
| WO | WO-9406314 | A1 | 3/1994 |
| WO | WO-9418860 | A1 | 9/1994 |
| WO | WO9527412 | | 10/1995 |
| WO | WO9632854 | | 10/1996 |
| WO | WO-9632854 | A2 | 10/1996 |
| WO | WO1996032854 | | 4/1997 |
| WO | WO9748293 | A1 | 12/1997 |
| WO | WO98017131 | | 4/1998 |
| WO | WO-9823171 | A1 | 6/1998 |
| WO | WO200009188 | | 2/2000 |
| WO | WO200021598 | | 4/2000 |
| WO | WO0028842 | | 5/2000 |
| WO | WO00/50111 | | 8/2000 |
| WO | WO-0167819 | A1 | 9/2001 |
| WO | WO2002051468 | | 7/2002 |
| WO | WO2002058747 | | 8/2002 |
| WO | WO2002058747 | A1 | 8/2002 |
| WO | WO-03012565 | A1 | 2/2003 |
| WO | WO2003028409 | A1 | 4/2003 |
| WO | WO-03037412 | A2 | 5/2003 |
| WO | WO 2003/050405 | A1 | 6/2003 |
| WO | WO-03059413 | A2 | 7/2003 |
| WO | WO-03070031 | A1 | 8/2003 |
| WO | WO2003083283 | A1 | 10/2003 |
| WO | WO 2003/101454 | | 12/2003 |
| WO | WO-03103387 | A2 | 12/2003 |
| WO | WO2004/022128 | | 3/2004 |
| WO | WO2004022242 | | 3/2004 |
| WO | WO2004022243 | | 3/2004 |
| WO | WO 2004089126 | | 10/2004 |
| WO | WO2005106350 | A2 | 11/2005 |
| WO | WO2006082571 | | 8/2006 |
| WO | WO-2007012007 | A2 | 1/2007 |
| WO | WO-2007017482 | A1 | 2/2007 |
| WO | WO 2007/042941 | | 4/2007 |
| WO | WO 2007040941 | A2 | 4/2007 |
| WO | WO 2007/131449 | A | 11/2007 |
| WO | WO-2007131450 | A1 | 11/2007 |
| WO | WO2007141668 | | 12/2007 |
| WO | WO2008038144 | | 4/2008 |
| WO | WO-2008108889 | A1 | 9/2008 |
| WO | WO-2008121610 | A1 | 10/2008 |
| WO | WO-2009001082 | A1 | 12/2008 |
| WO | WO2009015410 | | 2/2009 |
| WO | WO-2009022232 | A2 | 2/2009 |
| WO | WO-2009092862 | A1 | 7/2009 |

(56) References Cited

FOREIGN PATENT DOCUMENTS

| | | | |
|---|---|---|---|
| WO | WO2009118085 | A1 | 10/2009 |
| WO | WO2009132793 | A1 | 11/2009 |
| WO | WO2010045670 | A1 | 4/2010 |
| WO | WO2010045671 | A1 | 4/2010 |
| WO | WO-2010073018 | A1 | 7/2010 |
| WO | WO2010102832 | | 9/2010 |
| WO | WO-2010107613 | A1 | 9/2010 |
| WO | WO-2010118644 | A1 | 10/2010 |
| WO | WO-2010133342 | A1 | 11/2010 |
| WO | WO2011045609 | | 4/2011 |
| WO | WO 2011/050943 | A1 | 5/2011 |
| WO | WO-2011050964 | A1 | 5/2011 |
| WO | WO-2011063970 | A1 | 6/2011 |
| WO | WO-2011068020 | A1 | 6/2011 |
| WO | WO-2011079932 | A1 | 7/2011 |
| WO | WO2011109849 | A1 | 9/2011 |
| WO | WO2012014490 | | 2/2012 |
| WO | WO2012025496 | A1 | 3/2012 |
| WO | WO-2013022936 | A1 | 2/2013 |
| WO | WO2013034453 | A1 | 3/2013 |
| WO | WO-2013034454 | A1 | 3/2013 |
| WO | WO-2013034458 | A1 | 3/2013 |
| WO | WO-2013034459 | A1 | 3/2013 |
| WO | WO-2013034460 | A1 | 3/2013 |
| WO | WO2013034460 | A1 | 3/2013 |
| WO | WO2013057185 | A1 | 4/2013 |
| WO | WO 2013/082173 | | 6/2013 |
| WO | WO-2013098395 | A1 | 7/2013 |
| WO | WO2013098395 | A1 | 7/2013 |
| WO | WO 2013/113612 | | 8/2013 |
| WO | WO2013116558 | | 8/2013 |
| WO | WO2013116572 | | 8/2013 |
| WO | WO2014130695 | | 8/2013 |
| WO | WO-2013131764 | A1 | 9/2013 |
| WO | WO2013152873 | A1 | 10/2013 |
| WO | WO-2013160112 | A2 | 10/2013 |
| WO | WO 2014/012906 | | 1/2014 |
| WO | WO 2014/045025 | | 3/2014 |
| WO | WO-2014037794 | A2 | 3/2014 |
| WO | WO2014061477 | A1 | 4/2014 |
| WO | WO2014140320 | A1 | 9/2014 |
| WO | WO2014150131 | A1 | 9/2014 |
| WO | WO-2014201432 | A1 | 12/2014 |
| WO | WO 2015/114328 | | 8/2015 |
| WO | WO 2015/165812 | | 11/2015 |
| WO | WO-2015177254 | A1 | 11/2015 |

OTHER PUBLICATIONS

Concept Group, "New Super Insulator form Concept Group Stops Heat Conduction in Tight Spaces," https://www.businesswire.com/news/home/20110610006023/en/New-Super-Insulator-Concept-Group-Stops-Heat, 2011, 5 pages.
Concept Group, "Insulon® Thermal Barrier from Concept Group Blocks Heat with Hyper-Deep Vacuum™," Dec. 15, 2011, 1 page.
Davies, et al., "Metallic Foams: Their Production, Properties and Applications," Journal of Materials Science, 1983, vol. 18(7), pp. 1899-1911.
Decision to Grant a Patent dated Nov. 15, 2016 for Japanese Application No. 2015-506185 filed Apr. 11, 2013, 5 pages.
Examination Report for New Zealand Application No. 718007 dated Aug. 1, 2016, 4 pages.
Examination Report dated Jan. 9, 2019 for Philippines Application No. 1/2016/500805, 6 pages.
Examination Report dated Feb. 21, 2018 for Australian Application No. 2016204192, 7 pages.
Extended European Search Report for Application No. 15200661.5, dated May 18, 2016, 6 pages.
Extended European Search Report for Application No. 18157257.9, dated Jun. 28, 2018, 7 pages.
First Office Action dated Jun. 15, 2015 and Search Report dated Jun. 2, 2015 for Chinese Application No. 201280029784.X, filed Aug. 24, 2012, 27 pages.
First Office Action dated Dec. 3, 2015 for Chinese Application No. 201380021387.2, filed Apr. 11, 2011, 20 pages.
International Preliminary Report on Patentability for Application No. PCT/EP2012/066484, dated Mar. 20, 2014, 7 pages.
International Preliminary Report on Patentability for Application No. PCT/EP2012/066485, dated Dec. 20, 2013, 12 pages.
International Preliminary Report on Patentability for Application No. PCT/EP2014/072828, dated May 12, 2016, 7 pages.
International Preliminary Report on Patentability for Application No. PCT/EP2012/066486, dated Oct. 22, 2013, 10 pages.
International Preliminary Report on Patentability for Application No. PCT/EP2012/066523, dated Nov. 4, 2013, 9 pages.
International Preliminary Report on Patentability for Application No. PCT/EP2012/066524, dated Oct. 17, 2013, 11 pages.
International Search Report and Written Opinion for Application No. PCT/EP2013/057539, dated Feb. 11, 2014, 16 pages.
International Search Report and Written Opinion for Application No. PCT/EP2014/072828, dated Jun. 16, 2015, 10 pages.
International Search Report and Written Opinion for Application No. PCT/EP2012/066484, dated Jan. 9, 2013, 9 pages.
International Search Report and Written Opinion for Application No. PCT/EP2012/066486, dated Jan. 14, 2013, 8 pages.
International Search Report and Written Opinion for Application No. PCT/EP2012/066523, dated Jan. 9, 2013, 9 pages.
International Search Report and Written Opinion for Application No. PCT/EP2012/066524, dated Jan. 9, 2013, 8 pages.
International Search Report and Written Opinion for Application No. PCT/EP2012/066525, dated Jan. 9, 2013, 10 pages.
International Search Report and Written Opinion for Application no. PCT/AT2011/000123, dated Jul. 18, 2011, 8 pages.
International Search Report and Written Opinion for Application No. PCT/EP2012/066485, dated Dec. 10, 2012, 10 pages.
Merriam-Webster, "Definition of Film", Retrieved from the Internet: https://www.merriam-webster.com/dictionary/Film on Sep. 17, 2019, 13 pages.
National Plastic Heater, Sensor and Control Inc., "Kapton (Polyimide) Flexible Heaters," 2011, retrieved from https://www.kapton-silicone-flexible-heaters.com/products/kapton_polyimide_flexible_heaters.html on Feb. 23, 2018, 2 pages.
International Preliminary Report on Patentability for Application No. PCT/EP2012/066525, dated Mar. 20, 2014, 8 pages.
Notice of Opposition dated Mar. 7, 2017 for European Application No. 12750770.5, 22 pages.
Office Action dated Jan. 23, 2019 for Korean Application No. 20187017575, 9 pages.
Office Action dated Jul. 8, 2016 for Chinese Application No. 201380021387.2, filed Apr. 11, 2011, 12 pages.
Office Action dated Sep. 25, 2018 for European Application No. 12750765.5 filed Aug. 24, 2012, 1 page.
Office Action dated Sep. 26, 2018 for European Application No. 12750765.5 filed Aug. 24, 2012, 1 page.
Office Action dated Sep. 29, 2015 for Japanese Application No. 2015-506185 filed Apr. 11, 2013, 10 pages.
Office Action dated Mar. 31, 2015 for Japanese Application No. 2014-519585 filed Aug. 24, 2012, 8 pages.
Office Action dated Apr. 7, 2015 for Japanese Application No. 2014-519586 filed Aug. 24, 2012, 10 pages.
Office Action and Search Report dated Apr. 27, 2015 for Chinese Application No. 201280030681.5, filed Aug. 24, 2012, 25 pages.
Office Action dated Jul. 4, 2018 for Russian Application No. 2018101312, 11 pages.
Office Action dated Apr. 5, 2019 for Korean Application No. 10-2018-7019884, 8 pages.
Office Action dated Sep. 6, 2017 for Korean Application No. 10-2017-7017425, 9 pages.
Office Action dated Sep. 6, 2017 for Korean Application No. 10-2017-7017430, 9 pages.
Office Action dated Jan. 11, 2019 for European Application No. 12750771.3, 44 pages.
Office Action dated May 11, 2018 for Korean Application No. 10-2017-7008071, 17 pages.
Office Action dated Jan. 16, 2017 for Chinese Application No. 201380048636.7, 24 pages.

(56) References Cited

OTHER PUBLICATIONS

Office Action dated Aug. 17, 2016 for Korean Application No. 10-2014-7032958, 13 pages.
Office Action dated Mar. 20, 2019 for Korean Application No. 10-2017-7008071, 2 pages.
Office Action dated Mar. 20, 2019 for Korean Application No. 10-2017-7008071, 3 pages.
Office Action dated Apr. 24, 2019 for Chinese Application No. 201710413187.1, 16 pages.
Office Action dated Apr. 24, 2019 for Chinese Application No. 201710412726.X, 21 pages.
Office Action dated Jan. 24, 2019 for European Application No. 12750771.3, 40 pages.
Office Action dated Jan. 25, 2019 for European Application No. 12750771.3, 2 pages.
Office Action dated Dec. 26, 2017 for Chinese Application No. 201480059966.0, 29 pages.
Office Action dated Jul. 27, 2018 for Korean Application No. 10-2013-7033866, 22 pages.
Office Action dated Jun. 27, 2017 for Japanese Application No. 2016-527295, 8 pages.
Office Action dated Aug. 28, 2019 for Indian Application No. 201647014549, 6 pages.
Office Action dated Jul. 28, 2017 for Korean Application No. 10-2016-7010831, 11 pages.
Patio Kits Direct, "Insulated Roof Panels," DIY Alumawood Patio Cover Kits, dated Sep. 20, 2018, as available at https://www.patiokitsdirect.com/about-insulation, 2 pages.
Search Report dated Mar. 24, 2015 for Chinese Application No. 201280029767.6 filed Aug. 24, 2012, 6 pages.
Second Office Action dated Jan. 16, 2017 for Chinese Application No. 201380048636.7, 24 pages.
Translation of Office Action dated Mar. 25, 2019 for Chinese Application No. 201610804046.8, 17 pages.
Warrier M., et al., "Effect of the Porous Structure of Graphite on Atomic Hydrogen Diffusion and Inventory," Nucl. Fusion, vol. 47, 2007, pp. 1656-1663.
Written Opinion for Application No. PCT/EP2012/066485, dated Oct. 15, 2013, 6 pages.
European Search Report, Application No. 18205608.5 dated Jul. 12, 2019, 7 pages.
Russian Search Report, Application No. 2018137501, dated Apr. 29,. 2019, 12 pages.
European Communication, Application No. 17189951.1, dated Jan. 25, 2019, 4 pages.
Japanese Office Action and Search Report, Application No. 2018-088088, dated Feb. 28, 2019, 25 pages.
Japanese Decision to Grant, Application No. 2011-532464, dated Aug. 5, 2014, 3 pages (6 pages with translation).
Russian Decision to Grant, Application No. 2011120430/14, dated Apr. 1, 2014, 10 pages.
Chinese Search Report, Application No. 201610086101.4, dated Apr. 25, 2018, 1 page.
Chinese Office Action, 201610086101.4, dated May 4, 2018, 3 pages.
Chinese Notification to Grant Patent, Application No. 201610086101.4, dated Oct. 25, 2018, 2 pages.
Chinese Office Action, Application No. 201610371843.1, dated Sep. 30, 2018, 6 pages (11 pages with translation).
Japanese Decision to Grant, Application No. JP2016-134648, dated May 22, 2018, 6 pages.
International Search Report and Written Opinion, Application No. PCT/GB2017/051139, dated Aug. 9, 2017, 16 pages.
International Preliminary Report on Patentability, Application No. PCT/GB2017/051139, dated Aug. 6, 2018, 8 pages.
Company Filtrona Richmond, Inc., www.filtronaporoustechnologies.com, dated Nov. 19, 2018, 1 page.
Japanese Search Report, Application No. 2011-532464, dated Sep. 19, 2013, 116 pages.
Japanese Search Report, Application No. 2014-179732, dated Aug. 25, 2015, 5 pages.
Japanese Search Report, Application No. 2016-134648, dated Apr. 14, 2017, 26 pages.
International Preliminary Report on Patentability dated Jun. 1, 2015 for International Patent Application No. PCT/EP2014/063785 filed Jun. 27, 2014.
International Search Report and Written Opinion for International Application No. PCT/EP2014/064365 dated Oct. 7, 2014.
International Search Report and Written Opinion for International Application No. PCT/EP2014/063785 dated Oct. 30, 2014.
International Preliminary Report on Patentability for corresponding International Application No. PCT/GB2015/051213 dated Jul. 14, 2016.
International Search Report for corresponding International Application No. PCT/GB2015/051213 dated Jul. 16, 2015.
Written Opinion of the International Preliminary Examining Authority for International Application No. PCT/GB2015/051213 dated Mar. 29, 2016.
International Search Report and Written Opinion dated Feb. 6, 2013 for PCT/EP0212/070647 filed Oct. 18, 2012.
Chinese Office Action for Chinese Application No. 201480024978.X dated Jan. 18, 2017.
European Search Report for European Application no. 15178588 dated Apr. 14, 2016.
International Preliminary Report on Patentability, dated Apr. 22, 2014, for International Patent Application No. PCT/EP2012/070647, filed Oct. 18, 2012.
International Search Report and Written Opinion for International Application no. PCT/EP2012/003103, dated Nov. 26, 2012.
Translation of Chinese Second Office Action for Chinese Application No. 200980152395.4 dated Aug. 20, 2013.
Japanese Reasons for Rejection for Japanese Application No. 2016134648 dated May 23, 2017.
International Search Report and Written Opinion for PCT/AT/2012/000017 dated Jul. 3, 2012.
International Search Report and Written Opinion for PCT/GB2014/051333 dated Jul. 17, 2014.
International Search Report and Written Opinion, International Application No. PCT/GB2014/051332 dated Jul. 21, 2014.
International Search Report and Written Opinion, International Application No. PCT/GB2014/051334 dated Jul. 21, 2014.
IPRP, International Application No. PCT/GB2014/051333 dated Aug. 5, 2015.
IPRP, International Application No. PCT/GB2014/051332 dated Nov. 12, 2015.
IPRP, International Application No. PCT/GB2014/051334 dated Nov. 12, 2015.
Japanese Notice of Reasons for Rejection for Japanese Application No. 2015-137361 dated May 31, 2016.
Russian Search Report for Russian Application No. 2015146843/12 (072088) date completed Apr. 24, 2017.
Russian Office Action, Application No. 2014120213/12, dated Oct. 26, 2016, 7 pages.
Russian Office Action, Application No. 2014120213/12, dated Sep. 22, 2017, 11 pages.
Chinese Office Action, Application No. 201480024988.3, dated Dec. 30, 2016, 26 pages.
Chinese Office Action, Application No. 201480024988.3, dated Sep. 11, 2017, 21 pages.
European Extended Search Report, Application No. 17189951.1, dated Jan. 4, 2018, 8 pages (11 pages with translation).
Plasma polymerization (the company Diener electronic GmbH+Co. KG), www.plasma.de, retrieved on Oct. 17, 2017, 19 pages.
International Preliminary Report on Patentability (WIPO English Translation), dated Aug. 13, 2013 for International Patent Application No. PCT/AT2012/000017, filed Feb. 2, 2012.
Pulmonary Pharmacoloy: Delivery Devices and Medications, dated Sep. 6, 2017, 2 pages, available at www.cdeu.org/cecourses/z98207/ch4.htm.
Dunn P and Reay D, Heat Pipes, 4th edition, 1994, ISBN 0080419038, 14 pages.

(56) References Cited

OTHER PUBLICATIONS

Japanese Notice of Reasons for Rejection dated Sep. 8, 2015 for Japanese Application No. 2014179732.
Japanese Notice of Reasons for Rejection dated Oct. 7, 2013 for Japanese Application No. 2011532464.
Application and File History for U.S. Appl. No. 14/127,144, filed Mar. 31, 2014, inventor Egoyants.
Application and File History for U.S. Appl. No. 14/127,133, filed Jul. 15, 2014, inventor Vasiliev.
Dunn et al., "Heat Pipes". Fourth Edition. Pergamon. (1994) 14 pages. ISBN 0080419038.
European Search Report for European Application No. 16166656 dated Oct. 11, 2016.
Notice of Opposition Letter from EPO. Opposition against: EP2358418 dated Mar. 1, 2017.
Rudolph G, Bat Cigarettenfabriken GmbH, 1987, The Influence of CO2 on the Sensory Characteristics of the Favor-System, http://legacy.library.ucsf.edu/tid/sla51f00.
Application and File History for U.S. Appl. No. 14/127,148, filed Mar. 12, 2014, inventor Egoyants.
Application and File History for U.S. Appl. No. 14/127,138, filed Feb. 10, 2014 , inventor Egoyants.
Japanese Decision to Grant, Application No. 2016-134648, dated May 22, 2018, 3 pages (4 pages with translation).
Japanese Office Action, Application No. 2016-564977, dated Dec. 5, 2017, 3 pages (6 pages with translation).
Japanese Search Report, Application No. 2016-864977, dated Oct. 25, 2017, 9 pages (19 pages with translation).
Chinese Office Action, Application No. 201580022356.8, dated Jul. 18, 2018, 8 pages (15 pages with translation).
International Search Report for International Application No. PCT/AT2009/000414 dated Jan. 26, 2010.
Kynol, *Kynol Standard Specifications of Activated Carbon Fiber Products*, 2 pages, as retrieved on Sep. 19, 2013.
Application and File History for U.S. Appl. No. 14/127,879, filed May 9, 2014 inventor Egoyants.
Application and File History for U.S. Appl. No. 14/962,817, filed Dec. 8, 2015 , inventor Egoyants.
Application and File History for U.S. Appl. No. 15/379,946, filed Dec. 15, 2016, inventor Egoyants.
Chinese Office Action, Application No. 201480037049.2, dated May 9, 2017, 10 pages, (28 pages with translation).
Japanese Office Action, Application No. 2016-522550, dated Jul. 4, 2017, 4 pages (7 pages with translation).
Japanese Decision to Grant a Patent, Application No. : 2016-522550, dated Nov. 14, 2017, 3 pages (6 pages with translation).
Japanese Office Action, Application No. 2016-522550, dated Jan. 31, 2017, 4 pages (7 pages with translation).
International Search Report for corresponding International Application No. PCT/EP2015/064595 dated Jan. 5, 2016; 6 pages.
Written Opinion of the International Searching Authority for corresponding International Application No. PCT/EP2015/064595 dated Jan. 5, 2016; 11 pages.
International Preliminary Report on Patentability for corresponding International Application No. PCT/EP2015/064595 dated Oct. 25, 2016; 20 pages.
Written Opinion of the International Preliminary Examining Authority for corresponding International Application No. PCT/EP2015/064595 dated Jun. 13, 2016, 8 pages.
Application and File History for U.S. Appl. No. 15/437,522, filed Feb. 21, 2017, inventors Abramov et al.
Application and File History for U.S. Appl. No. 15/437,517, filed Feb. 21, 2017, inventors Abramov et al.
Chinese Office Action, Application No. 2013800472843, dated Nov. 13, 2017, 4 pages (13 pages with translation).
Japanese Office Action, Application No. 2017-017842, dated Dec. 26, 2017, 3 pages (6 pages with translation).
Chinese Office Action, Application No. 201580034981.4, dated Aug. 3, 2018, 21 pages.
Japanese Office Action, Application No. 2016-575543, dated Dec. 4, 2018, 17 pages.
Application and File History for U.S. Appl. No. 14/899,629, filed Dec. 18, 2015, inventors Brereton et al.
Application and File History for U.S. Appl. No. 14/902,663, filed Jan. 4, 2016, inventors Harding et al.
Japanese Office Communication dated Jan. 31, 2017 for Japanese Patent Application No. 2016-522550. English translation not available.
Russian Office Action, for Russian Application No. 2016103729, 15 pages.
International Search Report for International Application No. PCT/AT2009/000413 dated Jan. 25, 2010.
Translation of Chinese First Office Action for Chinese Application No. 200980152395.4 dated Dec. 3, 2012.
Application and File History for U.S. Appl. No. 14/343,368, filed Jun. 24, 2014, inventors Abramov et al.
Korean Office Action, Application No. 10-2019-7037986, dated Feb. 6, 2020, 11 pages.
English Translation for Vietnam Opposition for Application No. PCT/EP2013/057539, dated Jun. 29, 2018, 29 pages.
European Extended Search Report for European Application No. 201576220, dated May 28, 2020, 12 pages.
Extended European search report for Application No. 20157622.0, dated May 28, 2020, 12 pages.
International Preliminary Report on Patentability for Application No. PCT/US2012/066523, dated Jun. 4, 2015, 6 pages.
International Search Report and Written Opinion for Application No. PCT/US2012/066523, dated May 29, 2013, 7 pages.
Minco Products Inc., "Thermofoil™ Heaters," Bulletin HS-202(D), Jul. 22, 2004, 60 pages.
Office Action dated May 10, 2020 for Brazilian Application No. BR112014004818-5, 6 pages.
The opposition to petition not to grant of a patent for the Vietnam Application No. 1-2014-03877, mailed on Apr. 27, 2018, 35 pages.
Vietnam Opposition for Application No. PCT/EP2013/057539, mailed on Jun. 29, 2018, 6 pages.
Examination Report for Canadian Application No. 2,845,754, dated Nov. 4, 2020, 5 pages.
Office Action dated Jun. 16, 2020 for Japanese Application No. 2019-065344, 10 pages.

* cited by examiner

HEATING SMOKABLE MATERIAL

RELATED APPLICATION

This application is a continuation of application Ser. No. 15/437,517 filed Feb. 21, 2017, which in turn is a continuation of application Ser. No. 14/343,368 filed Jun. 24, 2014, now U.S. Pat. No. 9,609,894, issued Apr. 4, 2017, which in turn is a National Stage of International Application No. PCT/EP2012/066525 filed Aug. 24, 2012, which claims the benefit of RU Patent Application No. 2011136869 filed Sep. 6, 2011, GB Patent Application No.: 1207054.6, filed Apr. 23, 2012, and RU Patent Application No. 2012124800, filed Jun. 15, 2012, each of which is hereby fully incorporated herein by reference.

FIELD

The invention relates to heating smokable material.

BACKGROUND

Smoking articles such as cigarettes and cigars burn tobacco during use to create tobacco smoke. Attempts have been made to provide alternatives to these smoking articles by creating products which release compounds without creating tobacco smoke. Examples of such products are so-called heat-not-burn products which release compounds by heating, but not burning, tobacco.

SUMMARY

According to the invention, there is provided an apparatus comprising a smokable material heater, configured to heat a first region of smokable material to a volatizing temperature sufficient to volatize a component of smokable material and to concurrently heat a second region of smokable material to a temperature lower than said volatizing temperature but which is sufficient to prevent condensation of volatized components of the smokable material.

The apparatus may be configured to control the temperature of the first region of smokable material independently of the temperature of the second region of smokable material.

The heater may comprise a plurality of heating regions including a first heating region arranged to heat the first region of smokable material and a second heating region arranged to concurrently heat the second region of smokable material.

The plurality of heating regions may be operable separately and independently to concurrently heat different regions of the smokable material to different temperatures.

The apparatus may be configured to cause the first heating region to heat the first region of smokable material to said volatizing temperature and to cause the second heating region to concurrently heat the second region of smokable material to said lower temperature.

Subsequently, the apparatus may be configured to cause the first heating region to heat the first region of smokable material to said lower temperature and to cause the second heating region to concurrently heat the second region of smokable material to said volatizing temperature.

Subsequently, the apparatus may be configured to cause a third heating region to heat a third region of smokable material to said volatizing temperature and to cause the first and/or second heating region(s) to heat the first and/or second regions of smokable material to said lower temperature.

The apparatus may be configured to successively heat different regions of smokable material to said volatizing temperature whilst concurrently heating regions of smokable material not heated to said volatizing temperature to said lower temperature to prevent condensation of volatized components.

The apparatus may comprise a smokable material heating chamber for containing the smokable material during heating.

The heating chamber may be located adjacent the heater.

The lower temperature may prevent condensation of volatized components in the heating chamber.

The apparatus may comprise a mouthpiece through which volatized components of the smokable material can be inhaled.

The volatizing temperature may be 100 degrees Celsius or higher.

The lower temperature may be less than 100 degrees Celsius.

According to the invention, there is provided a method of manufacturing the apparatus.

According to the invention, there is provided a method of heating smokable material comprising: heating a first region of the smokable material to a volatizing temperature to volatize at least one component of the smokable material for inhalation; and concurrently heating a second region of the smokable material to a temperature lower than the volatizing temperature but which is sufficient to prevent condensation of volatized components of the smokable material.

For exemplary purposes only, embodiments of the invention are described below with reference to the accompanying figures in which:

DETAILED DESCRIPTION

Figure 1:
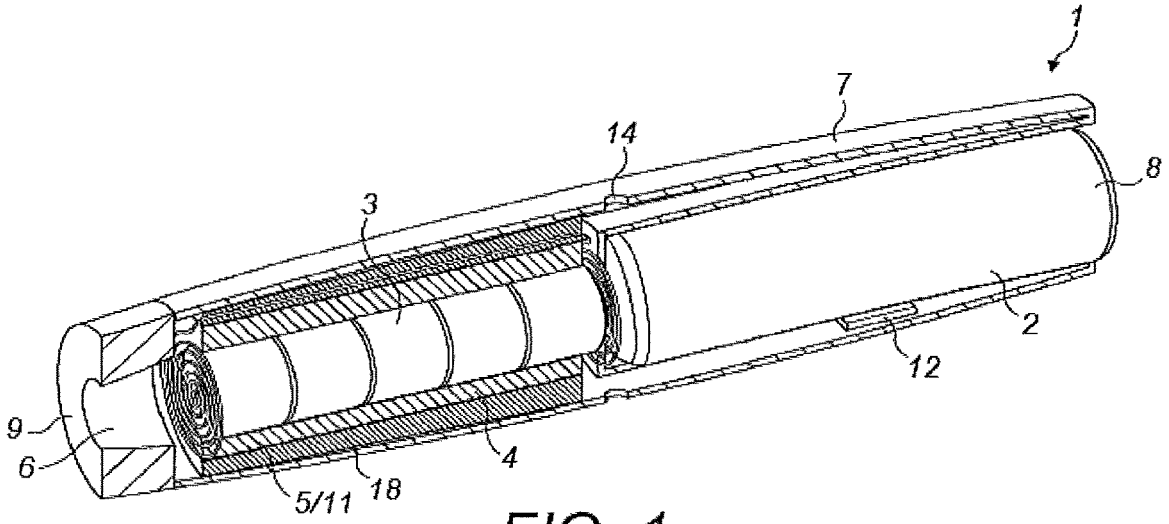
FIG. 1 is a perspective, partially cut-away illustration of an apparatus configured to heat smokable material to release aromatic compounds and/or nicotine from the smokable material.

As used herein, the term 'smokable material' includes any material that provides volatilized components upon heating and includes any tobacco-containing material and may, for example, include one or more of tobacco, tobacco derivatives, expanded tobacco, reconstituted tobacco or tobacco substitutes.

An apparatus 1 for heating smokable material comprises an energy source 2, a heater 3 and a heating chamber 4. The energy source 2 may comprise a battery such as a Li-ion battery, Ni battery, Alkaline battery and/or the like, and is electrically coupled to the heater 3 to supply electrical energy to the heater 3 when required. The heating chamber 4 is configured to receive smokable material 5 so that the smokable material 5 can be heated in the heating chamber 4. The heating chamber 4 is located adjacent to the heater 3 so that thermal energy from the heater 3 heats the smokable material 5 therein to volatilize aromatic compounds and nicotine in the smokable material 5, without burning the smokable material 5. A mouthpiece 6 is provided through which a user of the apparatus 1 can inhale the volatilized compounds during use of the apparatus 1. The smokable material 5 may comprise a tobacco blend.

The heater 3 may comprise a substantially cylindrical, elongate heater 3 and the heating chamber 4 may be located either outwardly or inwardly of a longitudinal external surface of the heater 3. For example, with reference to FIG. 1, the heating chamber 4 may be located around the outside of a circumferential, longitudinal surface of the heater 3. The heating chamber 4 and smokable material 5 may therefore comprise co-axial layers around the heater 3. Alternatively, referring to FIG. 2, the heating chamber 4 may be located internally of the longitudinal surface of the heater 3 so that the heating chamber 4 comprises a core or other cavity internal of the heating surface. As will be evident from the discussion below, other shapes and configurations of the heater 3 and heating chamber 4 can alternatively be used.

Figure 2:
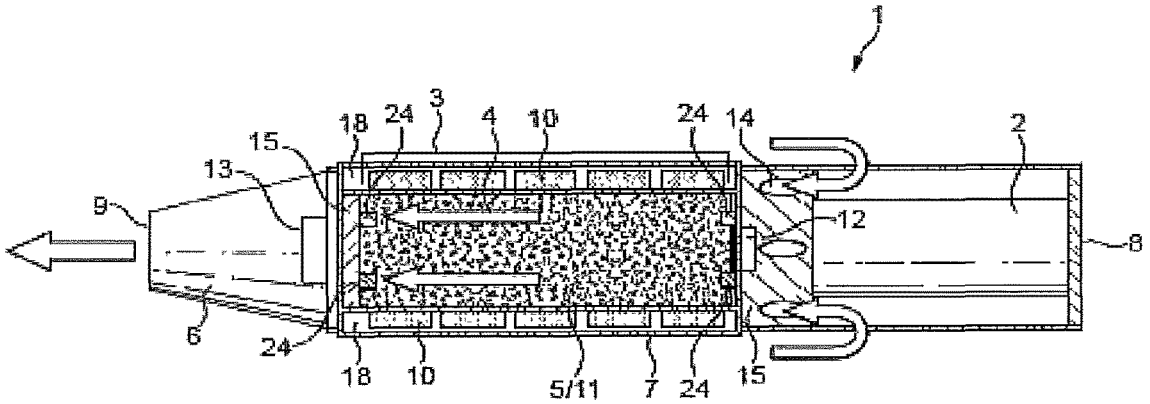
FIG. 2 is an illustration of an apparatus configured to heat smokable material, in which a heater is located externally of a smokable material heating chamber so as to provide heat in a radially inward direction to heat smokable material therein.

A housing 7 may contain components of the apparatus 1 such as the energy source 2 and heater 3. The housing 7 may comprise an approximately cylindrical tube with the energy source 2 located towards its first end 8 and the heater 3 and heating chamber 4 located towards its opposite, second end 9. The energy source 2 and heater 3 extend along the longitudinal axis of the housing 7. For example, as shown in FIGS. 1 and 2, the energy source 2 and heater 3 can be aligned along the central longitudinal axis of the housing 7 in a substantially end-to-end arrangement so that an end face of the energy source 2 substantially faces an end face of the heater 3. Heat insulation may be provided between the energy source 2 and the heater 3 to prevent direct transfer of heat from one to the other.

The length of the housing 7 may be approximately 130 mm, the length of the energy source may be approximately 59 mm, and the length of the heater 3 and heating region 4 may be approximately 50 mm. The diameter of the housing 7 may be between approximately 9 mm and approximately 18 mm. For example, the diameter of the housing's first end 8 may be between 15 mm and 18 mm whilst the diameter of the mouthpiece 6 at the housing's second end 9 may between 9 mm and 15 mm. The diameter of the heater 3 may be between approximately 2.0 mm and approximately 13.0 mm, depending on the heater configuration. For example, a heater 3 located externally of the heating chamber 4 such as that shown in FIG. 2 may have a diameter of between approximately 9.0 mm and approximately 13.0 mm whilst the diameter of a heater 3 located internally of the heating chamber 4, such as that shown in FIG. 1, may be between approximately 2.0 mm and approximately 4.5 mm, such as between approximately 4.0 mm and approximately 4.5 mm or between approximately 2.0 mm and approximately 3.0 mm. Heater diameters outside these ranges may alternatively be used. The diameter of the heating chamber 4 may be between approximately 5.0 mm and approximately 10.0 mm. For example, a heating chamber 4 located outwardly of the heater 3, such as that shown in FIG. 1, may have an exterior diameter of approximately 10 mm at its outwardly-facing surface whilst a heating chamber 4 located inwardly of the heater 3, such as that shown in FIG. 2, may have a diameter of between approximately 5 mm and approximately 8.0 mm such as between approximately 3.0 mm and approximately 6.0 mm. The diameter of the energy source 2 may be between approximately 14.0 mm and approximately 15.0 mm, such as 14.6 mm although other diameters of energy source 2 could equally be used.

The mouthpiece 6 can be located at the second end 9 of the housing 7, adjacent the heating chamber 4 and smokable material 5. The housing 7 is suitable for being gripped by a user during use of the apparatus 1 so that the user can inhale volatilized smokable material compounds from the mouthpiece 6 of the apparatus 1.

The heater 3 may comprise a ceramics heater 3, examples of which are shown in FIGS. 1 to 4. The ceramics heater 3 may, for example, comprise base ceramics of alumina and/or silicon nitride which are laminated and sintered.

Figure 5:
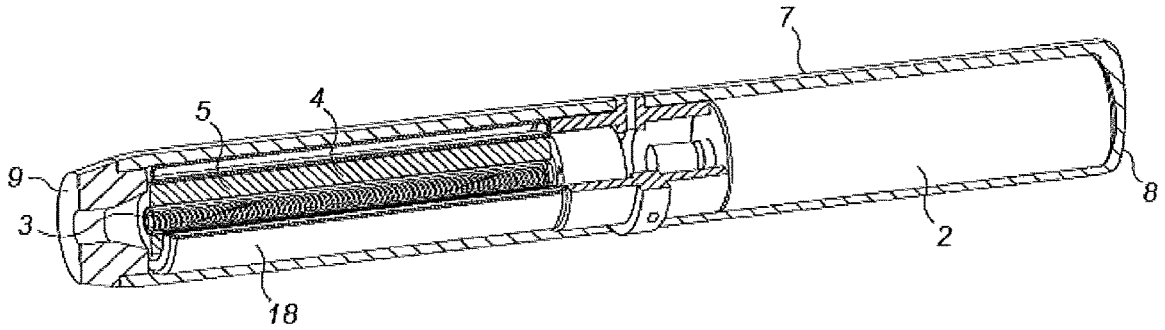
FIG. 5 is a perspective, partially cut-away illustration of an apparatus configured to heat smokable material, in which the smokable material is provided around an elongate infra-red heater.
Figure 6:
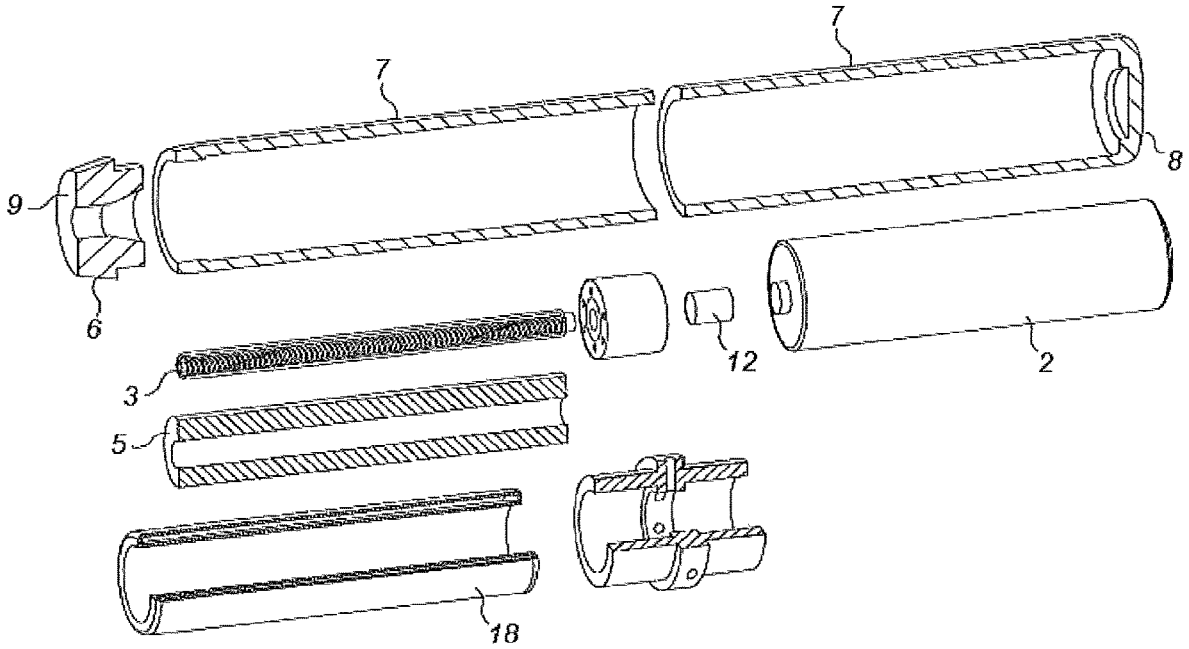
FIG. 6 is an exploded, partially cut-away illustration of an apparatus configured to heat smokable material, in which the smokable material is provided around an elongate infra-red heater.

Alternatively, referring to FIGS. 5 and 6, the heater 3 may comprise an infra-red (IR) heater 3 such as a halogen-IR lamp 3. The IR heater 3 may have a low mass and therefore its use can help to reduce the overall mass of the apparatus 1. For example, the mass of the IR heater may be 20% to 30% less than the mass of a ceramics heater 3 having an equivalent heating power output. The IR heater 3 also has low thermal inertia and therefore is able to heat the smokable material 5 very rapidly in response to an activation stimulus. The IR heater 3 may be configured to emit IR electromagnetic radiation of between approximately 700 nm and 4.5 μm in wavelength. Another alternative is to use a resistive heater 3, such as a resistive wire wound on a ceramic insulation layer deposited on a wall of the thermal insulation 18 referred to further below.

As indicated above and shown in FIG. 1, the heater 3 may be located in a central region of the housing 7 and the heating chamber 4 and smokable material 5 may be located around the longitudinal surface of the heater 3. In this arrangement, thermal energy emitted by the heater 3 may travel in a radial direction outwards from the longitudinal surface of the heater 3 into the heating chamber 4 and the smokable material 5. Alternatively, as shown in FIG. 2, the heater 3 may be located towards the periphery of the housing 7 and the heating chamber 4 and smokable material 5 may be located in a central region of the housing 7 which is internal from the longitudinal surface of the heater 3. In this arrangement, thermal energy emitted by the heater 3 travels in a radial direction inwards from a longitudinal surface of the heater 3 into the heating chamber 4 and the smokable material 5.

Figure 3:
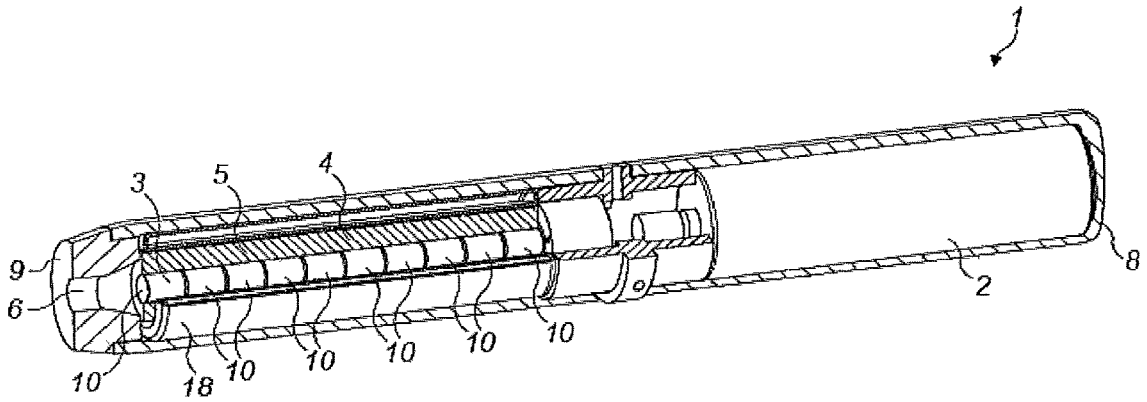
FIG. 3 is a perspective, partially cut-away illustration of an apparatus configured to heat smokable material, in which the smokable material is provided around an elongate ceramic heater divided into radial heating sections.

The heater 3 comprises a plurality of individual heating regions 10, as shown in FIGS. 2 and 3. The heating regions 10 are operable independently of one another so that different regions 10 can be activated at different times to heat the smokable material 5. The heating regions 10 may be arranged in the heater 3 in any geometric arrangement. However, in the examples shown in the figures, the heating regions 10 are geometrically arranged in the heater 3 so that different ones of the heating regions 10 are arranged to predominately and independently heat different regions of the smokable material 5.

For example, referring to FIGS. 2 and 3, the heater 3 may comprise a plurality of axially aligned heating regions 10 in a substantially elongate arrangement.

The regions 10 may each comprise an individual element of the heater 3. The heating regions 10 may, for example, all be aligned with each other along a longitudinal axis of the heater 3, thus providing a plurality of independent heating zones along the length of the heater 3. Each heating region 10 may comprise a heating cylinder 10 having a finite length which is significantly less than the length of the heater 3 as a whole. The cylinders 10 may comprise solid disks where each disk has a depth equivalent to the cylinder length referred to above. An example of this is shown in FIG. 3. Alternatively, the cylinders 10 may comprise hollow rings, an example of which is shown in FIG. 2. In this case, the arrangement of axially aligned heating regions 10 define the exterior of the heating chamber 4 and are configured to apply heat inwardly, predominately towards the central longitudinal axis of the chamber 4. The heating regions 10 are arranged with their radial, or otherwise transverse, surfaces facing one another along the length of the heater 3. The transverse surfaces of each region 10 may touch the transverse surfaces of its neighboring regions 10. Alternatively, the transverse surfaces of each region 10 may be separated from the transverse surfaces of its neighboring region(s) 10.

Thermal insulation 18 may be present between such separated heating regions 10, as discussed in more detail below. An example of this is shown in FIG. 2.

In this way, when a particular one of the heating regions 10 is activated, it supplies thermal energy to the smokable material 5 located radially inwardly or outwardly of the heating region 10 without substantially heating the remainder of the smokable material 5. For example, referring to FIG. 3, the heated region of smokable material 5 may comprise a ring of smokable material 5 located around the heating region 10 which has been activated. The smokable material 5 can therefore be heated in independent sections, for example ring or core sections, where each section corresponds to smokable material 5 located directly inwardly or outwardly of a particular one of the heating regions 10 and has a mass and volume which is significantly less than the body of smokable material 5 as a whole.

Figure 7:
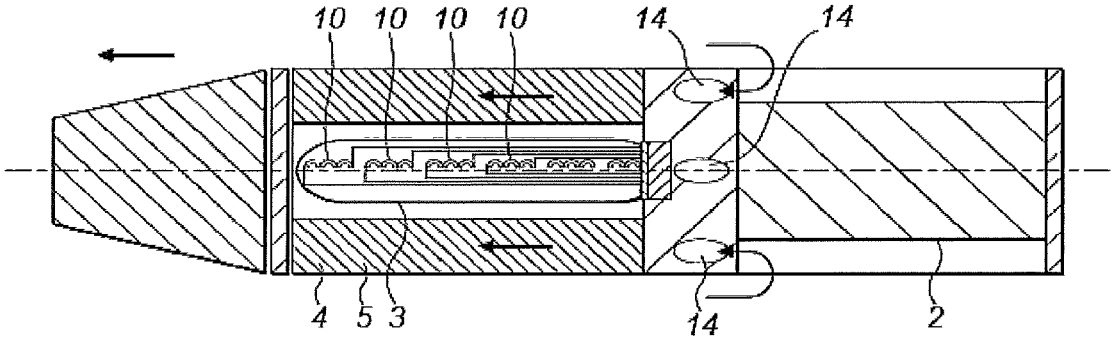
FIG. 7 is a schematic illustration of part of an apparatus configured to heat smokable material, in which the smokable material is provided around a plurality of longitudinal, elongate heating sections spaced around a central longitudinal axis.

In another alternative configuration, referring to FIG. 7, the heater 3 may comprise a plurality of elongate, longitudinally extending heating regions 10 positioned at different locations around the central longitudinal axis of the heater 3. Although shown as being of different lengths in FIG. 7, the longitudinally extending heating regions 10 may be of substantially the same length so that each extends along substantially the whole length of the heater 3. Each heating region 10 may comprise, for example, an individual IR heating element 10 such as an IR heating filament 10. Optionally, a body of heat insulation or heat reflective material may be provided along the central longitudinal axis of the heater 3 so that thermal energy emitted by each heating region 10 travels predominately outwards from the heater 3 into the heating chamber 4 and thus heats the smokable material 5. The distance between the central longitudinal axis of the heater 3 and each of the heating regions 10 may be substantially equal. The heating regions 10 may optionally be contained in a substantially infra-red and/or heat transparent tube, or other housing, which forms a longitudinal surface of the heater 3. The heating regions 10 may be fixed in position relative to the other heating regions 10 inside the tube.

In this way, when a particular one of the heating regions 10 is activated, it supplies thermal energy to the smokable material 5 located adjacent to the heating region 10 without substantially heating the remainder of the smokable material 5. The heated section of smokable material 5 may comprise a longitudinal section of smokable material 5 which lies parallel and directly adjacent to the longitudinal heating region 10. Therefore, as with the previous examples, the smokable material 5 can be heated in independent sections.

As will be described further below, the heating regions 10 can each be individually and selectively activated.

The smokable material 5 may be comprised in a cartridge ii which can be inserted into the heating chamber 4. For example, as shown in FIG. 1, the cartridge 11 can comprise a smokable material tube ii which can be inserted around the heater 3 so that the internal surface of the smokable material tube ii faces the longitudinal surface of the heater 3. The smokable material tube ii may be hollow. The diameter of the hollow centre of the tube 11 may be substantially equal to, or slightly larger than, the diameter of the heater 3 so that the tube 11 is a close fit around the heater 3. Alternatively, referring to FIG. 2, the cartridge 11 may comprise a substantially solid rod of smokable material 5 which can be inserted into a heating chamber 4 located inwardly of the heater 3 so that the external longitudinal surface of the rod ii faces the internal longitudinal surface of the heater 3. The length of the cartridge 11 may be approximately equal to the length of the heater 3 so that the heater 3 can heat the cartridge 11 along its whole length.

In another alternative configuration of heater 3, the heater 3 comprises a spirally shaped heater 3. The spirally shaped heater 3 may be configured to screw into the smokable material cartridge n and may comprise adjacent, axially-aligned heating regions 10 so as to operate in substantially the same manner as described for the linear, elongate heater 3 discussed above with reference to FIGS. 1 and 3.

Figure 8:
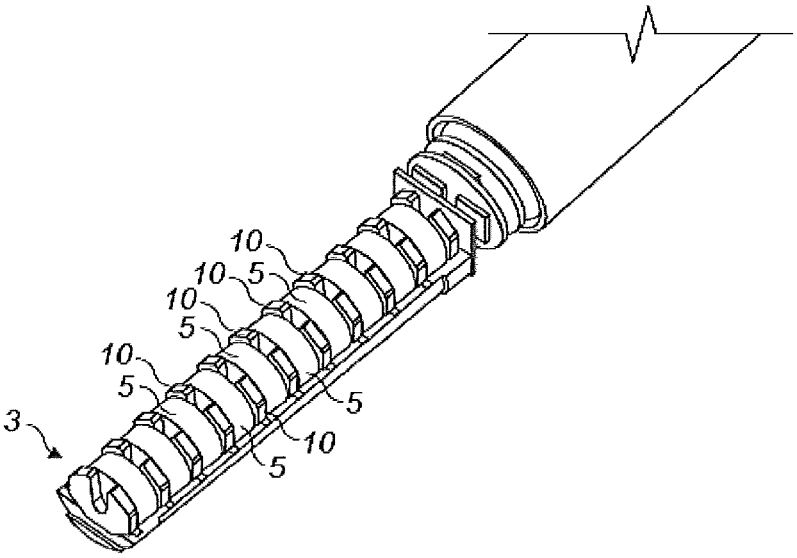
FIG. 8 is a perspective illustration of part of an apparatus configured to heat smokable material, in which the regions of smokable material are provided between pairs of upstanding heating plates.
Figure 9:
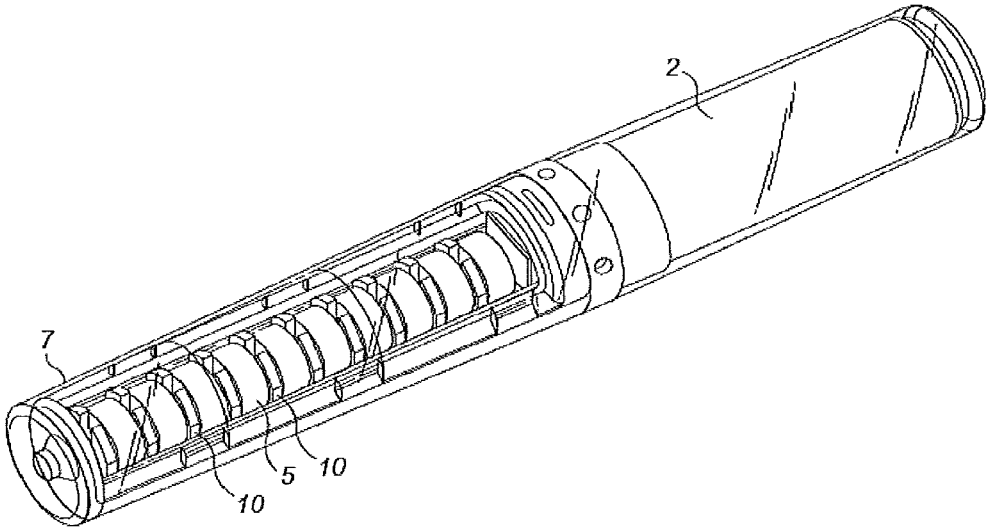
FIG. 9 is a perspective illustration of the apparatus shown in FIG. 7, in which an external housing is additionally illustrated.
Figure 10:
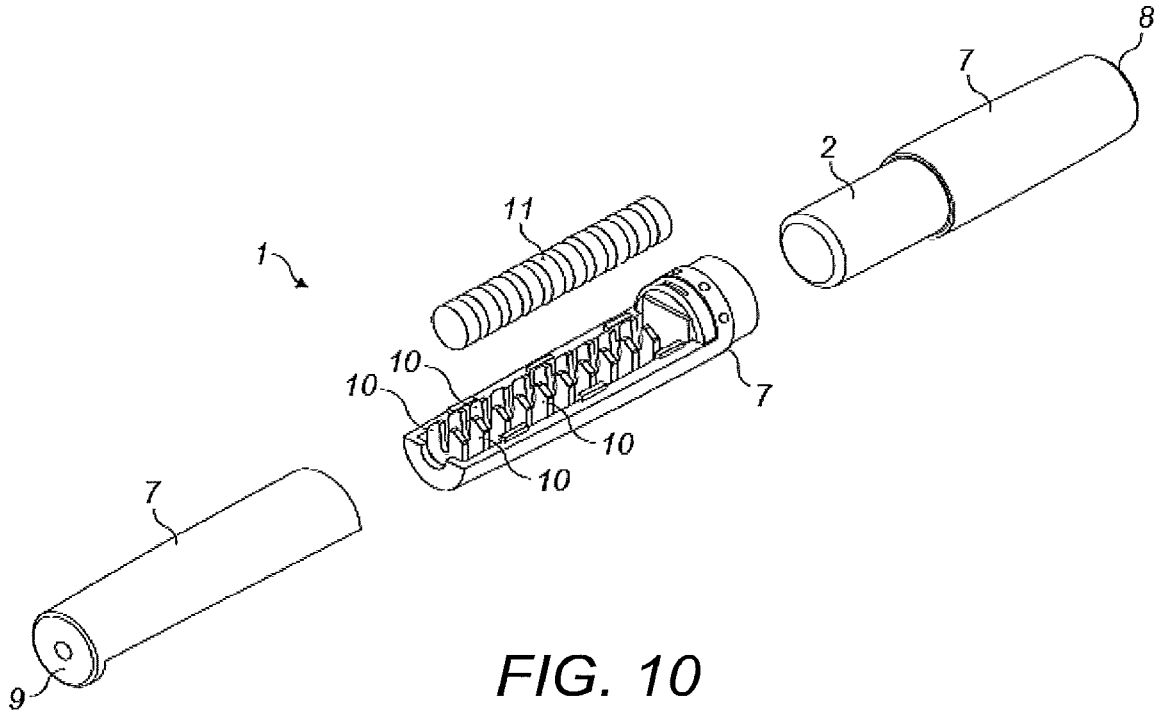
FIG. 10 is an exploded view of part of an apparatus configured to heat smokable material, in which the regions of smokable material are provided between pairs of upstanding heating plates.

Alternatively, referring to FIGS. 8, 9 and 10, a different geometrical configuration of heater 3 and smokable material 5 can be used. More particularly, the heater 3 can comprise a plurality of heating regions 10 which extend directly into an elongate heating chamber 4 which is divided into sections by the heating regions 10. During use, the heating regions 10 extend directly into an elongate smokable material cartridge 11 or other substantially solid body of smokable material 5. The smokable material 5 in the heating chamber 4 is thereby divided into discrete sections separated from each other by the spaced-apart heating regions 10. The heater 3, heating chamber 4 and smokable material 5 may extend together along a central, longitudinal axis of the housing 7. As shown in FIGS. 8 and 10, the heating regions 10 may each comprise a projection 10, such as an upstanding heating plate 10, which extends into the body of smokable material 5. The projections 10 are discussed below in the context of heating plates 10. The principal plane of the heating plates 10 may be substantially perpendicular to the principal longitudinal axis of the body of smokable 5 and heating chamber 4 and/or housing 7. The heating plates 10 may be parallel to one another, as shown in FIGS. 8 and 10. Each section of smokable material 5 is bounded by a main heating surface of a pair of heating plates 10 located either side of the smokable material section, so that activation of one or both of the heating plates 10 will cause thermal energy to be transferred directly into the smokable material 5. The heating surfaces may be embossed to increase the surface area of the heating plate 10 against the smokable material 5. Optionally, each heating plate 10 may comprise a thermally reflective layer which divides the plate 10 into two halves along its principal plane. Each half of the plate 10 can thus constitute a separate heating region 10 and may be independently activated to heat only the section of smokable material 5 which lies directly against that half of the plate 10, rather than the smokable material 5 on both sides of the plate 10. Adjacent plates 10, or facing portions thereof, may be activated to heat a section of smokable material 5, which is located between the adjacent plates, from substantially opposite sides of the section of smokable material 5.

The elongate smokable material cartridge or body 11 can be installed between, and removed from, the heating chamber 4 and heating plates 10 by removing a section of the housing 7 at the housing's second end 9, as previously described. The heating regions 10 can be individually and selectively activated to heat different sections of the smokable material 5 as required.

In this way, when a particular one or pair of the heating regions 10 is activated, it supplies thermal energy to the smokable material 5 located directly adjacent to the heating region(s) 10 without substantially heating the remainder of the smokable material 5. The heated section of smokable material 5 may comprise a radial section of smokable material 5 located between the heating regions 10, as shown in FIGS. 8 to 10.

The housing 7 of the apparatus 1 may comprise an opening through which the cartridge 11 can be inserted into the heating chamber 4. The opening may, for example, comprise an opening located at the housing's second end 9 so that the cartridge 11 can be slid into the opening and pushed directly into the heating chamber 4. The opening is preferably closed during use of the apparatus 1 to heat the smokable material 5. Alternatively, a section of the housing 7 at the second end 9 is removable from the apparatus 1 so that the smokable material 5 can be inserted into the heating chamber 4. An example of this is shown in FIG. 10. The apparatus 1 may optionally be equipped with a user-operable smokable material ejection unit, such as an internal mechanism configured to slide used smokable material 5 off and/or away from the heater 3. The used smokable material 5 may, for example, be pushed back through the opening in the housing 7. A new cartridge 11 can then be inserted as required.

Figure 14:
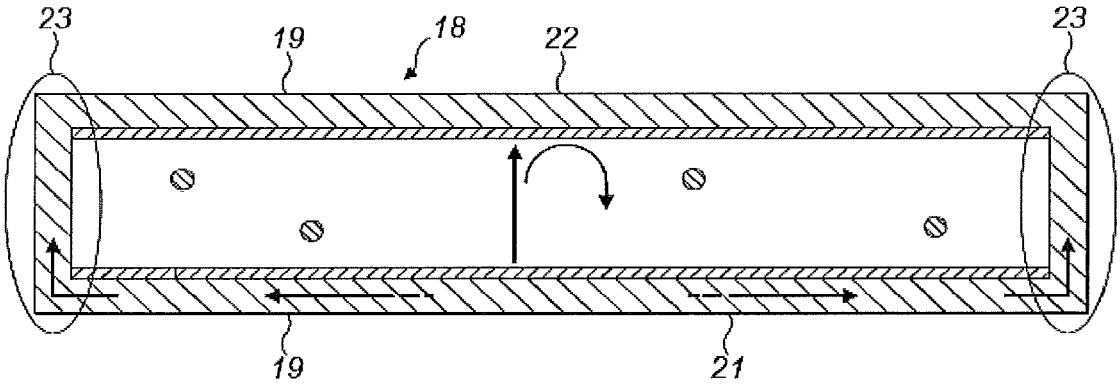
FIG. 14 is a schematic, cross-sectional illustration of a section of vacuum insulation configured to insulate heated smokable material from heat loss.

Thermal insulation 18 may be provided between the smokable material 5 and an external surface 19 of the housing 7. The thermal insulation reduces heat loss from the apparatus 1 and therefore improves the efficiency with which the smokable material 5 is heated. Referring to FIG. 14, the insulation 18 may comprise vacuum insulation 18. For example, the insulation 18 may comprise a layer which is bounded by a wall material 19 such as a metallic material. An internal region or core 20 of the insulation 18 may comprise an open-cell porous material, for example comprising polymers, aerogels or other suitable material, which is evacuated to a low pressure. The internal region 20 of the insulation 18 is configured to absorb gases which may be generated inside the region 20 to thereby maintain a vacuum state. The pressure in the internal region 20 may be in the range of 0.1 to 0.001 mbar. The wall 19 of the insulation 18 is sufficiently strong to withstand the force exerted against it due to the pressure differential between the core 20 and external surfaces of the wall 19, thereby preventing the insulation 18 from collapsing. The wall 19 may, for example, comprise a stainless steel wall 19 having a thickness of approximately 100 μm. The thermal conductivity of the insulation 18 may be in the range of 0.004 to 0.005 W/mK. The heat transfer coefficient of the insulation 18 may be between approximately 1.10 $W/(m^2K)$ and approximately 1.40 $W/(m^2K)$ within a temperature range of between approximately 100 degrees Celsius and 250 degrees Celsius, such as within a range of between approximately 150 degrees Celsius and approximately 250 degrees Celsius. The gaseous conductivity of the insulation 18 is negligible. A reflective coating may be applied to the internal surfaces of the wall material 19 to minimize heat losses due to radiation propagating through the insulation 18. The coating may, for example, comprise an aluminum IR reflective coating having a thickness of between approximately 0.3 μm and 1.0 μm. The evacuated state of the internal core region 20 means that the insulation 18 functions even when the thickness of the core region 20 is very small. The insulating properties are substantially unaffected by its thickness. This helps to reduce the overall size, particularly the diameter, of the apparatus 1.

As shown in FIG. 14, the wall 19 comprises an inwardly-facing section 21 and an outwardly-facing section 22. The inwardly-facing section 21 substantially faces the smokable material 5 and heating chamber 4. The outwardly-facing section 22 substantially faces the exterior of the housing .sub.7. During operation of the apparatus 1, the inwardly-facing section 21 may be warmer due to the thermal energy originating from the heater 3, whilst the outwardly-facing section 22 is cooler due to the effect of the insulation 18. The inwardly-facing section 21 and the outwardly-facing section 22 may both comprise substantially longitudinally-extending walls 19 which are at least as long as the heater 3 and heating chamber 4. The internal surface of the outwardly-facing wall section 22, i.e. the surface facing the evacuated core region 20, may comprise a coating for absorbing gas in the core 20. A suitable coating is a titanium oxide film.

As illustrated in FIG. 2, the overall length of the body of insulation 18 may be greater than the length of the heating chamber 4 and heater 3 so as to further reduce heat loss from the apparatus 1 to the atmosphere outside the housing 7. For example, the thermal insulation 18 may be between approximately 70 mm and approximately 80 mm.

Figure 15:
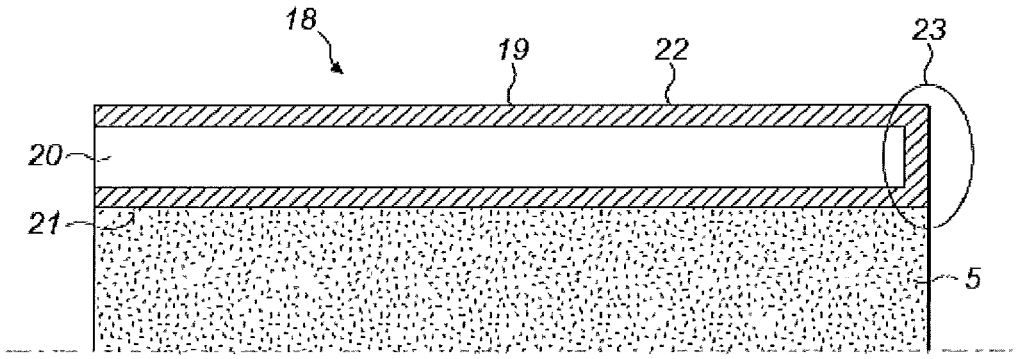
FIG. 15 is another schematic, cross-sectional illustration of a section of vacuum insulation configured to insulate heated smokable material from heat loss.

Referring to the schematic illustrations in FIGS. 14 and 15, a thermal bridge 23 may connect the inwardly-facing wall section 21 to the outwardly-facing wall section 22 at the ends of the insulation 18 in order to completely encompass and contain the low pressure core 20. The thermal bridge 23 may comprise a wall 19 formed of the same material as the inwardly and outwardly-facing sections 21, 22. A suitable material is stainless steel, as previously discussed. The thermal bridge 23 has a greater thermal conductivity than the insulating core 20 and so has a greater potential to undesirably conduct heat out of the apparatus 1 and thereby reduce the efficiency with which the smokable material 5 is heated than the core 20.

Figure 16:
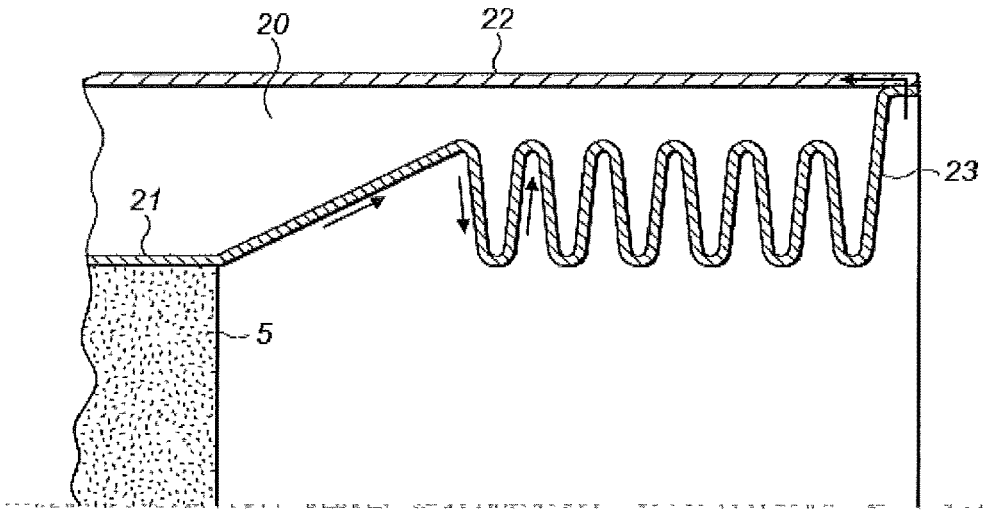
FIG. 16 is a schematic, cross-sectional illustration of a heat resistive thermal bridge which follows an indirect path from a higher temperature insulation wall to a lower temperature insulation wall.

To reduce heat losses due to the thermal bridge 23, the thermal bridge 23 may be extended to increase its resistance to heat flow from the inwardly-facing section 21 to the outwardly-facing section 22. This is schematically illustrated in FIG. 16. For example, the thermal bridge 23 may follow an indirect path between the inwardly-facing section 21 of the wall 19 and the outwardly-facing section 22 of the wall 19. The thermal bridge 23 is present at a longitudinal location in the apparatus 1 where the heater 3 and heating chamber 4 are not present. This means that the thermal bridge 23 gradually extends from the inwardly-facing section 21 to the outwardly-facing section 22 along the indirect path, thereby reducing the thickness of the core 20 to zero, at a longitudinal location in the housing 7 where the heater 3, heating chamber 4 and smokable material 5 are not present, thereby further limiting the conduction of heat out of the apparatus 1.

As referred to above with reference to FIG. 2, the heater 3 may be integrated with the thermal insulation 18. For example, the thermal insulation 18 may comprise a substantially elongate, hollow body, such as a substantially cylindrical tube of insulation 18 which is located co-axially around the heating chamber 4 and into which the heating regions 10 are integrated.

The thermal insulation 18 may comprise a layer in which recesses are provided in the inwardly facing surface profile 21. Heating regions 10 are located in these recesses so that the heating regions 10 face the smokable material 5 in the heating chamber 4. The surfaces of the heating regions 10 which face the heating chamber 4 may be flush with the inside surface 21 of the thermal insulation 18 in regions of the insulation 18 which are not recessed.

Integrating the heater 3 with the thermal insulation 18 means that the heating regions 10 are substantially surrounded by the insulation 18 on all sides of the heating regions 10 other than those which face inwardly towards the smokable material heating chamber 4. As such, heat emitted by the heater 3 is concentrated in the smokable material 5 and does not dissipate into other parts of the apparatus 1 or into the atmosphere outside the housing 7.

The integration of the heater 3 with the thermal insulation 18 also reduces the thickness of the combination of heater 3 and thermal insulation 18 compared to providing the heater 3 separately and internally of a layer of thermal insulation 18. This can allow the diameter of the apparatus 1, in particular the external diameter of the housing 7, to be reduced resulting in a conveniently sized slim-line product.

Alternatively, the reduction in thickness provided by the integration of the heater 3 with the thermal insulation 18 can allow a wider smokable material heating chamber 4 to be accommodated in the apparatus 1, or the introduction of further components, without any increase in the overall width of the housing 7, as compared to a device in which the heater 3 is separate and positioned internally from a layer of thermal insulation 18.

A benefit of integrating the heater 3 with the insulation 18 is that the size and weight of the combination of heater 3 and insulation 18 can be reduced compared to devices in which there is no integration of heater and insulation. Reduction of the heater size allows for a corresponding reduction in the diameter of the housing. Reduction of the heater weight, in turn, decreases the heating ramp-up time and thereby reduces the warming-up time of the apparatus 1.

Additionally or alternatively to the thermal insulation 18, a heat reflecting layer may be present between the transverse surfaces of the heating regions 10. The arrangement of the heating regions 10 relative to each other may be such that thermal energy emitted from each one of the heating regions 10 does not substantially heat the neighboring heating regions 10 and instead travels predominately into the heating chamber 4 and smokable material 5. Each heating region 10 may have substantially the same dimensions as the other regions 10.

Figure 4:
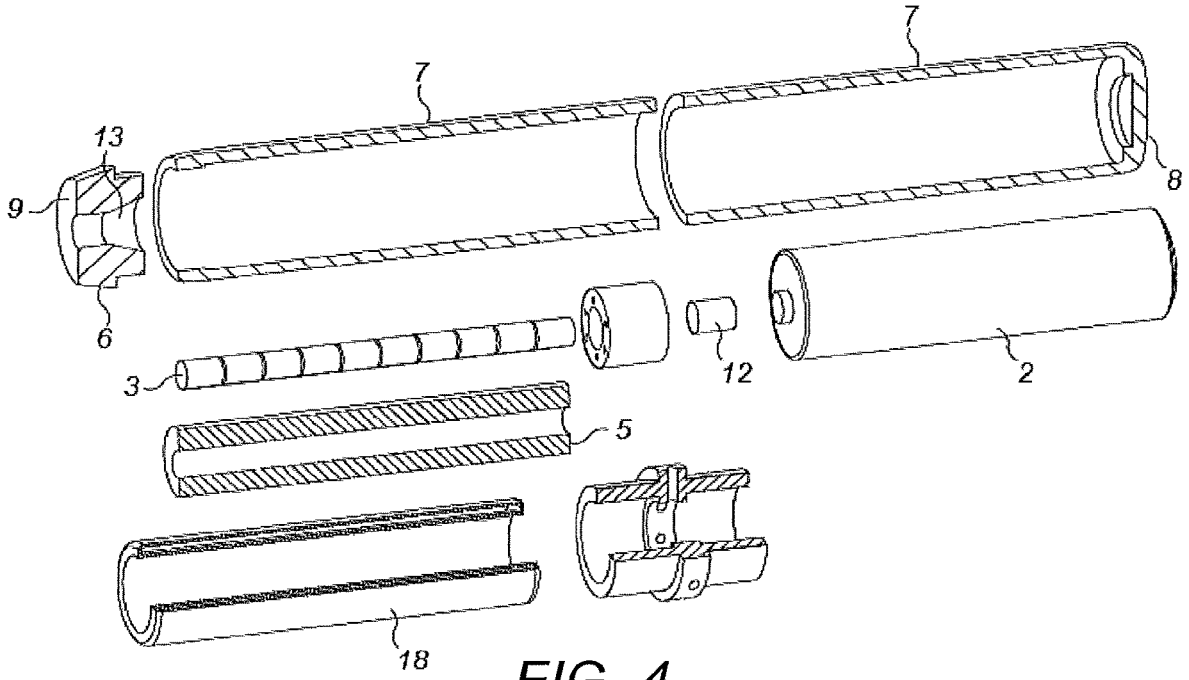
FIG. 4 is an exploded, partially cut-away view of an apparatus configured to heat smokable material, in which the smokable material is provided around an elongate ceramic heater divided into radial heating sections.

The apparatus 1 may comprise a controller 12, such as a microcontroller 12, which is configured to control operation of the apparatus 1. The controller 12 is electronically connected to the other components of the apparatus 1 such as the energy source 2 and heater 3 so that it can control their operation by sending and receiving signals. The controller 12 is, in particular, configured to control activation of the heater 3 to heat the smokable material 5. For example, the controller 12 may be configured to activate the heater 3, which may comprise selectively activating one or more heating regions 10, in response to a user drawing on the mouthpiece 6 of the apparatus 1. In this regard, the controller 12 may be in communication with a puff sensor 13 via a suitable communicative coupling. The puff sensor 13 is configured to detect when a puff occurs at the mouthpiece 6 and, in response, is configured to send a signal to the controller 12 indicative of the puff. An electronic signal may be used. The controller 12 may respond to the signal from the puff sensor 13 by activating the heater 3 and thereby heating the smokable material 5. The use of a puff sensor 13 to activate the heater 3 is not, however, essential and other means for providing a stimulus to activate the heater 3, such as a user-operable actuator, can alternatively be used. The volatilized compounds released during heating can then be inhaled by the user through the mouthpiece 6. The controller 12 can be located at any suitable position within the housing 7. An example position is between the energy source 2 and the heater 3/heating chamber 4, as illustrated in FIG. 4.

The controller 12 may be configured to activate, or otherwise cause warming of, the individual heating regions 10 in a predetermined order or pattern. For example, the controller 12 may be configured to activate the heating regions 10 sequentially along or around the heating chamber 4. Each activation of a heating region 10 may be in response to detection of a puff by the puff sensor 13 or may be triggered in an alternative way such as by the elapse of a predetermined period of time after the activation of the previous heating region 10 or by elapse of a predetermined period of time after initial activation of the heater (e.g. activation of the first region 10), as described further below.

Figure 11:
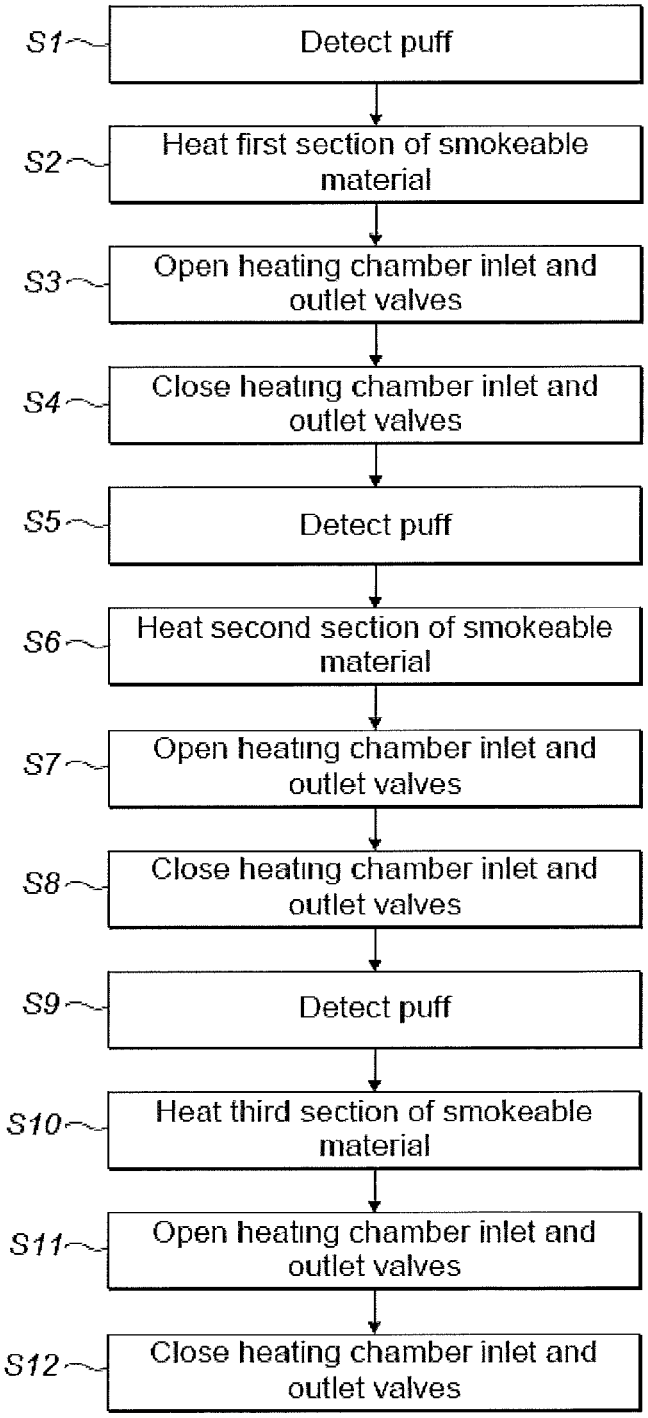
FIG. 11 is a flow diagram showing a method of activating heating regions and opening and closing heating chamber valves during puffing.

Referring to FIG. 11, an example heating method may comprise a first step S1 in which an activation stimulus such as a first puff is detected followed by a second step S2 in which a first section of smokable material 5 is heated in response to the activation stimulus. In a third step S3, hermetically sealable inlet and outlet valves 24 may be opened to allow air to be drawn through the heating chamber 4 and out of the apparatus 1 through the mouthpiece 6. In a fourth step, the valves 24 are closed. These valves 24 are described in more detail below with respect to FIGS. 2 and 18. In fifth S5, sixth S6, seventh S7 and eighth S8 steps, a second section of smokable material 5 may be heated, for example in response to another activation stimulus such as a second puff, with a corresponding opening and closing of the heating chamber inlet and outlet valves 24. In ninth S9, tenth S10, eleventh S11 and twelfth S12 steps, a third section of the smokable material 5 may be heated, for example in response to another activation stimulus such as a third puff, with a corresponding opening and closing of the heating chamber inlet and outlet valves 24, and so on. Means other than a puff sensor 13 could alternatively be used. For example, a user of the apparatus 1 may actuate a control switch to indicate that he/she is taking a new puff.

In this way, a fresh section of smokable material 5 may be heated to volatilize nicotine and aromatic compounds for each new puff or in response to a given quantity of certain components, such as nicotine and/or aromatic compounds, being released from the previously heated section of smokable material 5. The number of heating regions 10 and/or independently heatable sections of smokable material 5 may correspond to the number of puffs for which the cartridge 11 is intended to be used. Alternatively, each independently heatable smokable material section 5 may be heated by its corresponding heating region(s) 10 for a plurality of puffs such as two, three or four puffs, so that a fresh section of smokable material 5 is heated only after a plurality of puffs have been taken whilst heating the previous smokable material section.

As briefly referred to above, instead of activating each heating region 10 in response to an individual puff, the heating regions 10 may alternatively be activated sequentially, for example over a predetermined period of use, one after the other. This may occur in response to an initial activation stimulus such as a single, initial puff at the mouthpiece 6. For example, the heating regions 10 may be activated at regular, predetermined intervals over the expected inhalation period for a particular smokable material cartridge 11. The predetermined intervals may correspond to the period which is taken to release a given amount of certain components such as nicotine and/or aromatic compounds from each smokable material section. An example interval is between approximately 60 and 240 seconds. Therefore, at least the fifth and ninth steps S5, S9 shown in FIG. 11 are optional. Each heating region 10 may continue to be activated for a predetermined period, which may correspond to the duration of the intervals referred to above or may be longer, as described below. Once all of the heating regions 10 have been activated for a particular cartridge 11, the controller 12 may be configured to indicate to the user that the cartridge ii should be changed. The controller 12 may, for example, activate an indicator light at the external surface of the housing 7.

It will be appreciated that activating individual heating regions 10 in order rather than activating the entire heater 3 means that the energy required to heat the smokable material 5 is reduced over what would be required if the heater 3 were activated fully over the entire inhalation period of a cartridge 11. Therefore, the maximum required power output of the energy source 2 is also reduced. This means that a smaller and lighter energy source 2 can be installed in the apparatus 1.

The controller 12 may be configured to de-activate the heater 3, or reduce the power being supplied to the heater 3, in between puffs. This saves energy and extends the life of the energy source 2. For example, upon the apparatus 1 being switched on by a user or in response to some other stimulus, such as detection of a user placing their mouth against the mouthpiece 6, the controller 12 may be configured to cause the heater 3, or next heating region 10 to be used to heat the smokable material 5, to be partially activated so that it heats up in preparation to volatilize components of the smokable material 5. The partial activation does not heat the smokable material 5 to a sufficient temperature to volatilize nicotine. A suitable temperature may be 100° C. or below, although temperatures below 120° C. could be used. An example is a temperature between 60° C. and 100° C., such as a temperature between 80° C. and 100° C. The temperature may be less than 100° C. In response to detection of a puff by the puff sensor 13, or some other stimulus such as the elapse of a predetermined time period, the controller 12 may then cause the heater 3 or heating region 10 in question to heat the smokable material .sub.5 further in order to rapidly volatilize the nicotine and other aromatic compounds for inhalation by the user. The temperature of a partially heated heating region 10 can be increased to full volatizing temperature in a shorter time period than if the heating region 10 was started from 'cold', i.e. without being partially heated.

Figure 13:
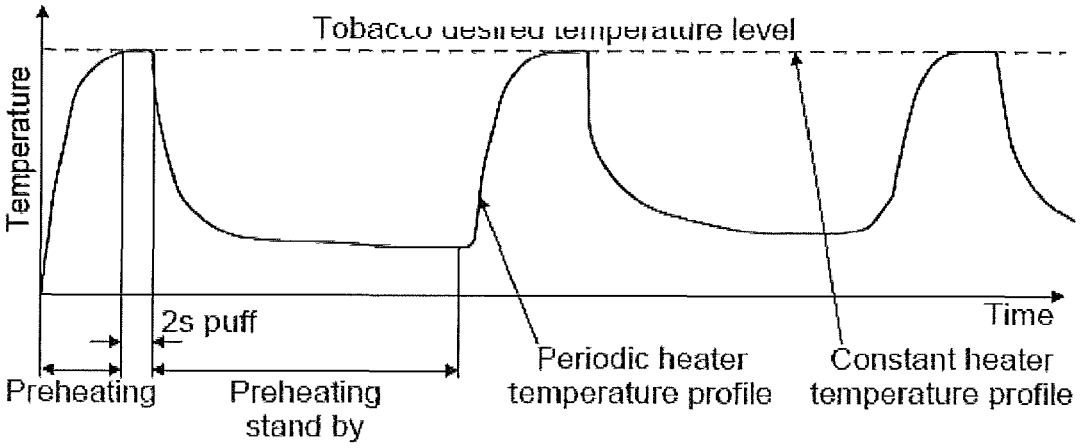
FIG. 13 is a graphical illustration of a heating pattern which can be used to heat smokable material using a heater.

If the smokable material 5 comprises tobacco, a suitable temperature for volatilizing the nicotine and other aromatic compounds may be 100° C. or above, such as 120° C. or above. An example is a temperature between 100° C. and 250° C., such as between 100° C. and 220° C., between 100° C. and 200° C., between 150° C. and 250° C. or between 130° C. and 180° C. The temperature may be more than 100° C. An example full activation temperature is 150° C., although other values such as 250° C. are also possible. A super-capacitor can optionally be used to provide the peak current used to heat the smokable material 5 to the volatization temperature. An example of a suitable heating pattern is shown in FIG. 13, in which the peaks may respectively represent the full activation of different heating regions 10. As can be seen, the smokable material 5 is maintained at the volatization temperature for the approximate period of the puff which, in this example, is two seconds.

Three example operational modes of the heater 3 are described below.

In a first operational mode, during full activation of a particular heating region 10, all other heating regions 10 of the heater are deactivated. Therefore, when a new heating region 10 is activated, the previous heating region is deactivated.

Power is supplied only to the activated region 10. The heating regions 10 may be activated sequentially along the length of the heater 3 so that nicotine and aromatic compounds are regularly released from fresh portions of smokable material 5 until the cartridge 11 is exhausted. This mode provides more uniform nicotine and smokable material flavor delivery than full activation of all heating regions 10 for the duration of the heating period of the cartridge 11. As with the other modes described below, power is also saved by not fully activating all of the heating regions 10 for the duration of the heating period of the smokable material cartridge 11.

Alternatively, in a second operational mode, once a particular heating region 10 has been activated, it remains fully activated until the heater 3 is switched off. Therefore, the power supplied to the heater 3 incrementally increases as more of the heating regions 10 are activated during inhalation from the cartridge 11. The continuing activation of the heating regions 10 throughout the chamber 4 substantially prevents condensation of components such as nicotine volatized from the smokable material 5 in the heating chamber 4.

Alternatively, in a third operational mode, during full activation of a particular heating region 10, one or more of the other heating regions 10 may be partially activated. Partial activation of the one or more other heating regions 10 may comprise heating the other heating region(s) 10 to a temperature which is sufficient to substantially prevent condensation of components such as nicotine volatized from the smokable material 5 in the heating chamber 4. An example is 100° C. Other examples include the ranges of partial activation temperatures previously described. The temperature of the heating regions 10 which are partially activated is less than the temperature of the heating region 10 which is fully activated. The smokable material 10 located adjacent the partially activated regions 10 is not heated to a temperature sufficient to volatize components of the smokable material 5. For example, upon full activation of a new heating region 10, the previously fully activated heating region 10 is partially but not fully deactivated so as to continue to heat its adjacent smokable material 5 at a lower temperature and thus prevent condensation of volatized components in the heating chamber 4. Retaining the previous, or any other, heating regions 10 in a partially rather than fully activated state during full activation of one or more other heating regions 10 prevents the smokable material 5 adjacent the fully activated regions 10 from becoming overly toasted and thus avoids potential negative effects on the flavours experienced by the user of the apparatus 1.

For any of the alternatives described above, the heating regions 10 may either be heated to full operational temperature immediately after activation or may initially be heated to a lower temperature, as previously discussed, before being fully activated after a predetermined period of time to heat the smokable material 5 to volatize nicotine and other aromatic compounds.

Figure 17:
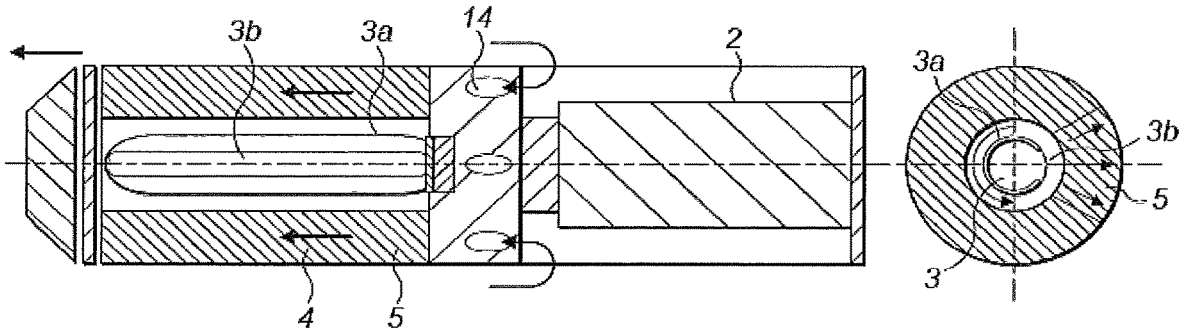
FIG. 17 is a schematic, cross-sectional illustration of a heat shield and a heat-transparent window which are moveable relative to a body of smokable material to selectively allow thermal energy to be transmitted to different sections of the smokable material through the window.

The apparatus 1 may comprise a heat shield 3*a*, which is located between the heater 3 and the heating chamber 4/smokable material 5. The heat shield 3*a* is configured to substantially prevent thermal energy from flowing through the heat shield 3*a* and therefore can be used to selectively prevent the smokable material 5 from being heated even when the heater 3 is activated and emitting thermal energy. Referring to FIG. 17, the heat shield 3*a* may, for example, comprise a cylindrical layer of heat reflective material which is located co-axially around the heater 3. Alternatively, if the heater 3 is located around the heating chamber 4 and smokable material 5 as previously described with reference to FIG. 2, the heat shield 3*a* may comprise a cylindrical layer of heat reflective material which is located co-axially around the heating chamber 4 and co-axially inside of the heater 3. The heat shield 3*a* may additionally or alternatively comprise a heat-insulating layer configured to insulate the heater 3 from the smokable material 5.

The heat shield 3*a* comprises a substantially heat-transparent window 3*b* which allows thermal energy to propagate through the window 3*b* and into the heating chamber 4 and smokable material 5. Therefore, the section of smokable material 5 which is aligned with the window 3*b* is heated whilst the remainder of the smokable material 5 is not. The heat shield 3*a* and window 3*b* may be rotatable or otherwise moveable with respect the smokable material 5 so that different sections of the smokable material 5 can be selectively and individually heated by rotating or moving the heat shield 3*a* and window 3*b*. The effect may be similar to the effect provided by selectively and individually activating the heating regions 10 referred to previously. For example, the heat shield 3*a* and window 3*b* may be rotated or otherwise moved incrementally in response to a signal from the puff detector 13. Additionally or alternatively, the heat shield 3*a* and window 3*b* may be rotated or otherwise moved incrementally in response to a predetermined heating period having elapsed. Movement or rotation of the heat shield 3*a* and window 3*b* may be controlled by electronic signals from the controller 12. The relative rotation or other movement of the heat shield 3*a*/window 3*b* and smokable material 5 may be driven by a stepper motor 3*c* under the control of the controller 12. This is illustrated in FIG. 17. Alternatively, the heat shield 3*a* and window 3*b* may be manually rotated using a user control such as an actuator on the housing 7. The heat shield 3*a* does not need to be cylindrical and may optionally comprise one or more suitably positioned longitudinally extending elements and or/plates.

It will be appreciated that a similar result can be obtained by rotating or moving the smokable material 5 relative to the heater 3, heat shield 3*a* and window 3*b*. For example, the heating chamber 4 may be rotatable around the heater 3. If this is the case, the above description relating to movement of the heat shield 3*a* can be applied instead to movement of the heating chamber 4 relative to the heat shield 3*a*.

The heat shield 3*a* may comprise a coating on the longitudinal surface of the heater 3. In this case, an area of the heater's surface is left uncoated to form the heat-transparent window 3*b*. The heater 3 can be rotated or otherwise moved, for example under the control of the controller 12 or user controls, to cause different sections of the smokable material 5 to be heated. Alternatively, the heat shield 3*a* and window 3*b* may comprise a separate shield 3*a* which is rotatable or otherwise moveable relative to both the heater 3 and the smokable material 5 under the control of the controller 12 or other user controls.

Figure 12:
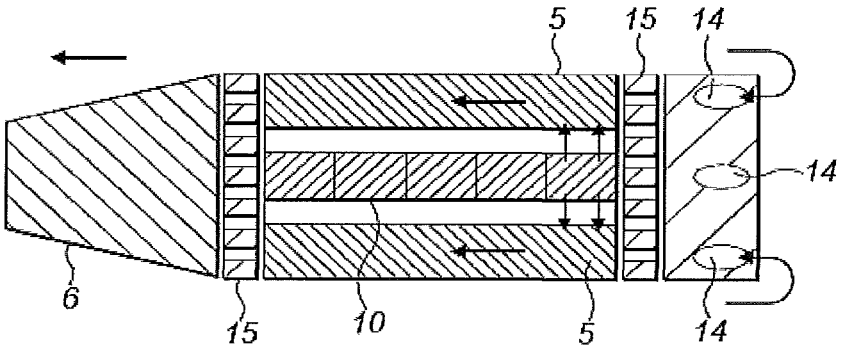
FIG. 12 is a schematic illustration of a gaseous flow through an apparatus configured to heat smokable material.
Figure 18:
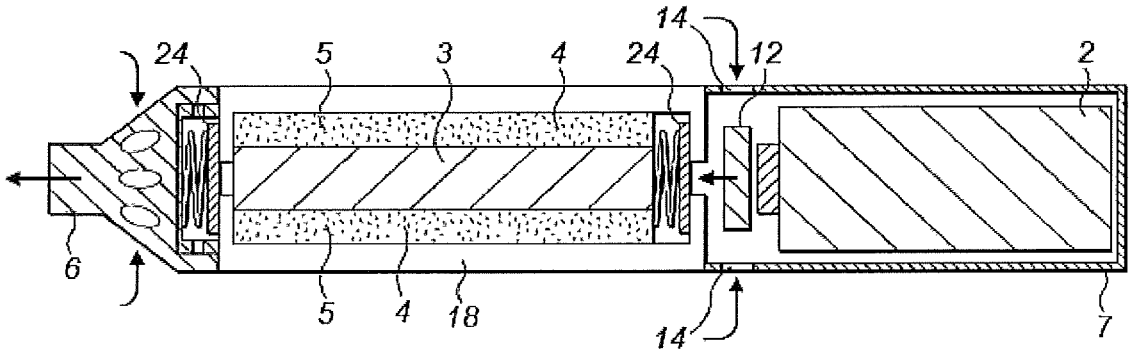
FIG. 18 is schematic, cross sectional illustration of part of an apparatus configured to heat smokable material, in which a heating chamber is hermetically sealable by check valves.

Referring to FIG. 7, the apparatus 1 may comprise air inlets 14 which allow external air to be drawn into the housing 7 and through the heated smokable material 5 during puffing. The air inlets 14 may comprise apertures 14 in the housing 7 and may be located upstream from the smokable material 5 and heating chamber 4 towards the first end 8 of the housing 7. This is shown in FIGS. 2, 12 and 18. Air drawn in through the inlets 14 travels through the heated smokable material 5 and therein is enriched with smokable material vapors, such as aroma vapors, before passing through the outlet valves 24 and being inhaled by the user at the mouthpiece 6. Optionally, as shown in FIG. 12, the apparatus 1 may comprise a heat exchanger 15 configured to warm the air before it enters the smokable material 5 and/or to cool the air before it is drawn through the mouthpiece 6. For example, the heat exchanger 15 may be configured to use heat extracted from the air entering the mouthpiece 6 to warm new air before it enters the smokable material 5.

Referring to FIG. 18, as previously discussed, the heating chamber 4 insulated by the insulation 18 may comprise inlet and outlet valves 24, such as check valves, which hermetically seal the heating chamber 4 when closed. The valves 24 may be one-way valves, where the inlet valve(s) 24 allows gaseous flow into the chamber 4 and the outlet valve(s) 24 allows gaseous flow out of the chamber 4. Gaseous flow in the opposite direction is prevented. The valves 24 can thereby prevent air from undesirably entering and exiting the chamber 4 and can prevent smokable material flavors from exiting the chamber 4. The inlet and outlet valves 24 may, for example, be provided in the insulation 18. Between puffs, the valves 24 may be closed by the controller 12, or other means such as a manually-operable actuator, so that all volatilized substances remain contained inside the chamber 4 in-between puffs. The partial pressure of the volatized substances between puffs reaches the saturated vapor pressure and the amount of evaporated substances therefore depends only on the temperature in the heating chamber 4. This helps to ensure that the delivery of volatilized nicotine and aromatic compounds remains constant from puff to puff.

During puffing, the valves 24 open so that air can flow through the chamber 4 to carry volatilized smokable material components to the mouthpiece 6. Opening of the valves 24 may be caused by the controller 12 or by other means. A membrane can be located in the valves 24 to ensure that no oxygen enters the chamber 4. The valves 24 may be breath-actuated so that the valves 24 open in response to detection of a puff at the mouthpiece 6. The valves 24 may close in response to a detection that a puff has ended. Alternatively, the valves 24 may close following the elapse of a predetermined period after their opening. The predetermined period may be timed by the controller 12. Optionally, a mechanical or other suitable opening/closing means may be present so that the valves 24 open and close automatically. For example, the gaseous movement caused by a user puffing on the mouthpiece 6 may exert a force on the valves 24 to cause them to open and close. Therefore, the use of the controller 12 is not required to actuate the valves 24.

The mass of the smokable material 5 which is heated by the heater 3, for example by each heating region 10, may be in the range of 0.2 to Log. The temperature to which the smokable material 5 is heated may be user controllable, for example to any temperature within the temperature range of 100° C. to 250° C., such as any temperature within the range of 150° C. to 250° C. and the other volatizing temperature ranges previously described. The mass of the apparatus 1 as a whole may be in the range of 70 to 125 g. A battery 2 with a capacity of 1000 to 3000 mAh and voltage of 3.7V can be used. The heating regions 10 may be configured to individually and selectively heat between approximately 10 and 40 sections of smokable material 5 for a single cartridge 11.

It will be appreciated that any of the alternatives described above can be used singly or in combination.

In order to address various issues and advance the art, the entirety of this disclosure shows by way of illustration various embodiments in which the claimed invention(s) may be practiced and provide for superior apparatuses and methods. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus for heating smokable material comprising:

a housing comprising an opening through which smokable material may be inserted; and a heater located in a central region of the housing configured to heat the smokeable material contained within the apparatus in use to volatilize at least one component of the smokeable material;

the heater comprising a plurality of independently operable individual heating regions aligned with each other along a longitudinal axis of the heater, wherein each heating region comprises a cylinder; and a smokeable material heating chamber located outwardly of a longitudinal external surface of the plurality of individual heating regions for containing the smokable material during heating, wherein a length of the heater approximately corresponds to a whole length of the smokable material, and wherein the plurality of independently operable individual heating regions are arranged such that, during heating, each heating region independently heats a corresponding section of the smokable material that is located radially outwardly of the respective heating region.

2. An apparatus according to claim 1, wherein the heater is elongate.

3. An apparatus according to claim 1, wherein the heating regions are operable separately and independently to concurrently heat different regions of the smokable material to different temperatures.

4. An apparatus according to claim 1, wherein the heating regions are operable separately and independently to heat different regions of the smokable material at different times.

5. An apparatus according to claim 1, further comprising thermal insulation located co-axially around the heating chamber.

6. An apparatus according to claim 1, wherein the housing comprises an approximately cylindrical tube with an energy source located towards a first end of the housing and the heater and the heating chamber located towards an opposite, second end of the housing.

7. An apparatus according to claim 1, comprising a mouthpiece through which volatized components of the smokable material can be inhaled.

8. An apparatus according to claim 1, wherein the apparatus is configured to heat the smokeable material without combusting the smokeable material.

9. An apparatus according to claim 1, wherein each cylinder comprises a solid disk.

10. An apparatus according to claim 1, further comprising smokeable material to be received in the apparatus.

11. A method of heating smokeable material to volatilize at least one component of the smokeable material for inhalation, comprising heating the smokeable material by the apparatus of claim 1.

12. An apparatus for heating smokable material comprising:

a housing;

a heater located in a central region of the housing configured to heat the smokeable material contained within the apparatus in use to volatilize at least one component of the smokeable material, wherein the heater comprises a plurality of independently operable individual heating regions aligned with each other along a longitudinal axis of the heater;

the housing comprising an opening through which smokable material may be inserted in use onto the heater, wherein used smokable material may be slid away from the heater following use; and a smokeable material heating chamber located outwardly of a longitudinal external surface of the heater for containing the smokable material during heating, wherein a length of the heater approximately corresponds to a whole length of the smokable material, and wherein the plurality of independently operable individual heating regions are arranged such that, during heating, each heating region independently heats a corresponding section of the smokable material that is located outwardly of the respective heating region.

13. An apparatus for heating smokable material comprising:

a housing; and a smokable material heating chamber located outwardly of a longitudinal external surface of a heater for removably receiving the smokable material during heating;

wherein the heater is located in a central region of the housing and is configured to heat the smokeable material contained within the apparatus in use to volatilize at least one component of the smokeable material, wherein the heater comprises a plurality of independently operable individual heating regions aligned with each other along a longitudinal axis of the heater, wherein the plurality of independently operable individual heating regions are arranged such that, during heating, each heating region independently heats a corresponding section of the smokable material that is located outwardly of the respective heating region, and wherein a length of the heater approximately corresponds to a whole length of the smokable material, and wherein the length of the heater is approximately 50 mm.

* * * * *